US010550687B2

(12) United States Patent
Betancourt et al.

(10) Patent No.: US 10,550,687 B2
(45) Date of Patent: Feb. 4, 2020

(54) METHODS FOR ANALYZING FORMATION TESTER PRETEST DATA

(71) Applicant: Schlumberger Technology Corporation, Sugar Land, TX (US)

(72) Inventors: Soraya S. Betancourt, Katy, TX (US); Elizabeth B. Dussan V., Watertown, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 362 days.

(21) Appl. No.: 14/762,779

(22) PCT Filed: Nov. 15, 2013

(86) PCT No.: PCT/US2013/070332
§ 371 (c)(1),
(2) Date: Jul. 22, 2015

(87) PCT Pub. No.: WO2014/120323
PCT Pub. Date: Aug. 7, 2014

(65) Prior Publication Data

US 2015/0354342 A1 Dec. 10, 2015

Related U.S. Application Data

(60) Provisional application No. 61/759,305, filed on Jan. 31, 2013.

(51) Int. Cl.
*E21B 47/06* (2012.01)

(52) U.S. Cl.
CPC ..... *E21B 47/06* (2013.01)

(58) Field of Classification Search
None
See application file for complete search history.

(56) References Cited

U.S. PATENT DOCUMENTS 4,423,625 A * 1/1984 Bostic, III ..... E21B 47/10 166/250.02
5,184,508 A * 2/1993 Desbrandes ..... E21B 23/006 166/264

(Continued)

FOREIGN PATENT DOCUMENTS

WO 2014120323 A1 8/2014

OTHER PUBLICATIONS

International Search Report for International Application No. PCT/US2013/070332 dated Feb. 13, 2014.

(Continued)

*Primary Examiner* — Michael Lebentritt
(74) *Attorney, Agent, or Firm* — Trevor G. Grove

(57) ABSTRACT

Methods are disclosed for processing, in real-time, pressure data acquired with a formation tester during a pretest to quickly establish the quality of the measurement being conducted. The methods can optimize pressure measurement operations by assessing whether it is desirable or not to wait for the formation tester flowline pressure to equilibrate to the sandface pressure. In one embodiment, a determination is made as to whether the pretest succeeded in establishing hydraulic communication between the formation and the flowline by comparing the pressure signal with a simulation of the pressure behavior corresponding to a false buildup during a dry test. In another embodiment, a determination is made as to whether the pretest succeeded in isolating the tool flowline and the formation from the wellbore by using the pressure signal to estimate the sandface pressure during buildup over time, and to compare the estimated sandface pressure signal with the borehole pressure.

20 Claims, 17 Drawing Sheets

(56) References Cited

U.S. PATENT DOCUMENTS 5,329,811 A 7/1994 Schultz et al.
5,602,334 A * 2/1997 Proett ..... E21B 49/008 73/152.05
5,703,286 A * 12/1997 Proett ..... E21B 49/008 73/152.05
6,843,118 B2 1/2005 Weintraub et al.
7,024,930 B2 4/2006 Follini et al.
7,788,972 B2 * 9/2010 Terabayashi ..... E21B 47/10 73/152.27
8,305,243 B2 * 11/2012 Yu ..... H03M 7/30 341/118
9,134,451 B2 * 9/2015 Rasmus ..... G01V 9/00
9,399,913 B2 * 7/2016 Murphy ..... E21B 49/10
9,581,019 B2 * 2/2017 Chang ..... E21B 49/008
9,638,034 B2 * 5/2017 Chen ..... E21B 49/008
2003/0167834 A1 * 9/2003 Weintraub ..... E21B 49/008 73/152.05
2004/0045706 A1 * 3/2004 Pop ..... E21B 47/10 166/250.07
2005/0133261 A1 * 6/2005 Ramakrishnan ..... E21B 47/10 175/40
2005/0165554 A1 * 7/2005 Betancourt ..... E21B 49/08 702/11
2006/0129365 A1 * 6/2006 Hammond ..... E21B 49/008 703/10
2007/0198192 A1 * 8/2007 Hsu ..... E21B 47/12 702/6
2009/0165548 A1 * 7/2009 Pop ..... E21B 49/008 73/152.51
2010/0175925 A1 * 7/2010 Ciglenec ..... E21B 49/10 175/107
2010/0274490 A1 * 10/2010 Gok ..... E21B 49/008 702/12
2011/0040536 A1 * 2/2011 Levitan ..... E21B 49/00 703/2
2012/0227480 A1 * 9/2012 Nguyen-Thuyet .... E21B 47/011 73/152.02
2012/0253679 A1 * 10/2012 Chang ..... E21B 49/088 702/11
2013/0019672 A1 * 1/2013 Hemsing ..... E21B 49/008 73/152.51
2013/0255367 A1 10/2013 Dussan, V et al.
2014/0230538 A1 * 8/2014 Hegeman ..... G01V 1/48 73/152.18
2014/0330522 A1 * 11/2014 Manin ..... E21B 47/06 702/12
2014/0360258 A1 * 12/2014 Hemsing ..... E21B 49/008 73/152.51
2015/0127262 A1 * 5/2015 Chen ..... E21B 49/087 702/2

OTHER PUBLICATIONS

Betancourt et al., "Effects of Temperature Variations on Formation Tester Pretests", Soc. Pet. Eng. Annual Technical Conference and Exhibition, Denver, Colorado, SPE 146647, Oct. 30-Nov. 2, 2011 (19 pages).
Dussan, "A Robust Method for Calculating Formation Mobility with a Formation Tester" SPE Reservoir Evaluation and Engineering, pp. 239-247, Apr. 2011.
Kasap, E., Huang, K., Shwe, T. & Georgi, D.—Jun. 1999 "Formation Rate Analysis Technique: Combined Drawdown and Buildup Analysis for Wireline Formation Test Data". SPERE 2 (3) SPE56841 (8 pages).
Proett, M., Waid, M., Heinze, J. & Franki, M. 1994a "Low Permeability Interpretation Using a New Wireline Format ion Tester "Tight Zone" Pressure Transient Analysis". In SPWLA 35th Annual Logging Symposium, Jun. 19-22, 1994 (25 pages).
Proett, M., Waid, M. & Kessler, C. 1994b "Real Time Pressure Analysis Methods Applied to Wireline Formation Test Data". In Soc. of Pet. Eng. Annual Technical Conference and Exhibition, New Orleans, LA., Sep. 25-28, 1994, SPE 28449 (16 pages).
International Preliminary Report on Patentability issued in the related PCT Application PCT/US2013/070332, dated Aug. 4, 2015 (6 pages).
Betancourt, "Some Aspects of Deep Formation Testing", PhD Dissertation, The University of Texas at Austin, http://repositories.lib.utexas.edu/handle/2152/ETD-UT-2012-05-5232 (2012) (280 pages).

* cited by examiner

METHODS FOR ANALYZING FORMATION TESTER PRETEST DATA

FIELD

The subject disclosure generally relates to testing of geological formations. More particularly, the subject disclosure relates to methods for analyzing pretest data of a formation tester tool during testing.

BACKGROUND

There is a growing demand for conducting formation pressure measurements, especially in low-mobility environments (less than 0.1 mD $cp^{-1}$). A tool used to conduct formation pressure measurements downhole is a formation tester such as the MDT™ (a trademark of Schlumberger) Modular Formation Dynamics Tester that determines the formation pore pressure and estimates the formation mobility (permeability/viscosity) and can collect samples of reservoir fluids. One challenge in the use of formation testers in low-mobility reservoirs is that because equilibration time is inversely proportional to the formation mobility, existing tools require a long time (up to several hours) for the pressure signal to equilibrate to the formation pressure. Moreover, equilibration is desirable for each pressure measurement, and measurements are made at several depths along a wellbore. In field operations, long waiting times with a stationary tool are undesirable, as they increase both the rig time and the risk of differential tool sticking. However, the information that formation testers can deliver is sufficiently valuable to operators that many are willing to wait, even hours, for the tool pressure to equilibrate to formation pressure if there is a guarantee that they will obtain good quality data.

Because of the long pressure equilibration times required for testing low mobility reservoirs, it is of commercial importance to implement robust real-time techniques to evaluate the quality of a test. In order to make an efficient use of the limited time available to evaluate the formation, it is desirable to assess as soon as possible whether it is worth waiting for the pressure signal to equilibrate, and if the field operations demand an early termination of the test, to at least extract the maximum amount of information from the data collected. Pressure measurement while drilling, where the control of the pretest is very limited, can also benefit from an assessment in real time as to the quality of the data being obtained.

The basic component of a formation tester for measuring the formation pore pressure is the tool flowline, which generally comprises a probe, a probe packer, a pretest piston, and a pressure sensor, all of which are connected by tubing. A formation tester pressure measurement starts when the tool is stationed in the wellbore at the desired depth and the probe is extended to make contact with the formation. In order to hydraulically isolate the probe and the formation from the wellbore, it is important that the packer makes a seal. After making a seal, in some tool designs, a piston that covers the probe orifice, known as the filter valve piston, is withdrawn. The filter valve piston is adapted to minimize the ingestion of solids in the tool flowline.

The pretest itself starts when a command is given to withdraw a pretest piston at a prescribed speed, $q_{piston}$, to increase the flowline volume by a prescribed amount, $\Delta V$. This is the drawdown period. The increase in the flowline volume causes a decrease in the flowline pressure, $P_{fl}$. Once the pretest piston stops, $P_{fl}$ increases until it equilibrates to the formation pore-pressure. This is known as the buildup period. The flowline pressure at the end of the drawdown and the rate of pressure change during buildup depend on the pretest parameters, $q_{piston}$ and $\Delta V$, on formation properties (mobility ($k/\mu$), and compressibility), and on the tool design (size of the probe orifice, flowline dead volume and flowline compressibility ($c_{eff}$)).

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In embodiments, a method is disclosed for processing, in real-time, pressure data acquired with a formation tester during a pretest to quickly establish the quality of the measurement being conducted. The method may be used to optimize pressure measurement operations by assessing whether it is desirable or not to wait for the formation tester flowline pressure to equilibrate to the sandface pressure.

In one embodiment, in assessing the quality of a pretest in real time, a determination is made as to whether the pretest succeeded in establishing hydraulic communication between the formation and the flowline fluid. This can be done by comparing the pressure signal with a simulation of the pressure behavior corresponding to a false buildup during a dry test (i.e., no fluid entering the flowline). In another embodiment, in assessing the quality of a pretest in real time, a determination is made as to whether the pretest succeeded in isolating the tool flowline and the formation from the wellbore as leaks in the seal around the probe could cause the pressure to equilibrate eventually to the wellbore pressure. This can be done by using the pressure signal to continually estimate the sandface pressure during buildup over time, and to compare the estimated sandface pressure signal with the borehole pressure.

In one embodiment, the user-defined pretest parameters utilized in the simulation of the thermally induced false buildup response include the speed of retraction of the pretest ($g_{piston}$), a pretest volume ($\Delta V$), parameters relating to the particular design of the formation tester, and parameters relating to the environmental conditions during the measurement. Parameters relating to the particular design of the tool may include, among others, radii and volumes of various flowline components, total flowline volume ($V_{flowline}$), and the radius of the probe orifice ($r_{probe}$), Environmental conditions may include wellbore parameters such as wellbore pressure ($P_{well}$), and wellbore temperature ($\Theta_{well}$).

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

Figure 1A:
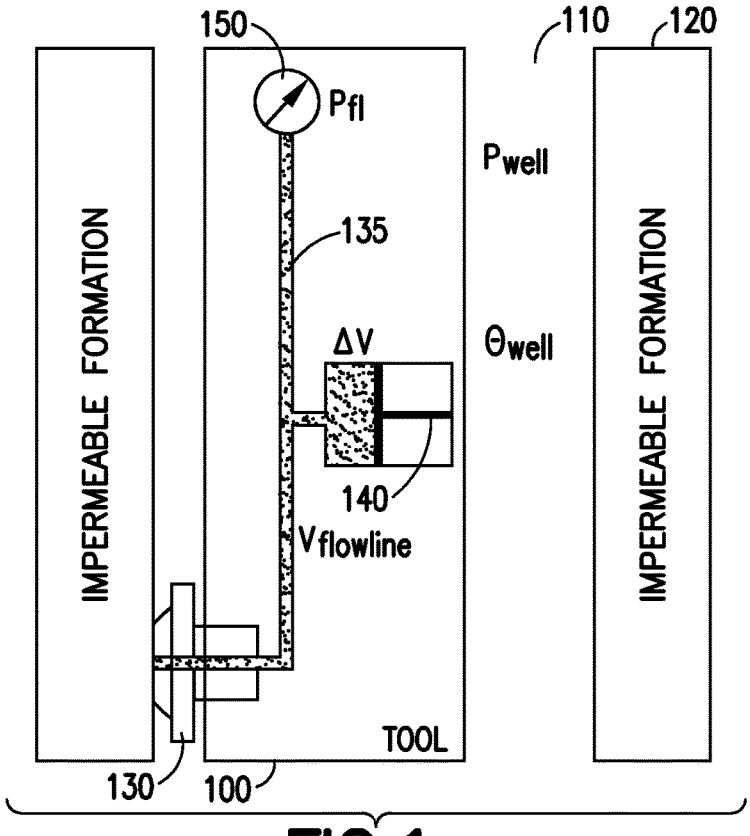
FIG. 1*a* is a schematic of a formation tester tool in a borehole.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice.

To assess the quality of a pretest in real time, in one embodiment a determination is made as to whether the pretest succeeded in establishing hydraulic communication between the formation and the flowline fluid. This is achieved by comparing the pressure signal with a simulation of the pressure behavior corresponding to a false buildup during a dry test (no fluid entering the flowline). In another embodiment, in assessing the quality of a pretest in real time, a determination is made as to whether the tool flowline has been isolated from the wellbore. This is achieved by estimating the sandface pressure using the pressure signal during buildup, a computation that is continuously updated as data is recorded, and comparing the measured pressure signal with the estimated sandface pressure.

According to one aspect, decisions regarding the pretest are made in real-time based on the relative behavior of three curves identified as: simulated false buildup, measured pressure signal, and real-time computation of sandface pressure. In one embodiment, formation mobility is also computed in real-time during the buildup. Details regarding the computations for generating the false buildup up (dry pretest) curve, and the real-time estimate of sandface pressure (and mobility), are described below.

The input parameters which are used for the computations include:

- flowline dimensions: radii and volumes of the various flowline components, total flowline volume ($V_{flowline}$), and the radius of the probe orifice, ($r_{probe}$);
- wellbore parameters: wellbore pressure ($P_{well}$), wellbore temperature ($\Theta_{well}$), and drilling fluid type;
- pretest parameters: speed of retraction of the pretest piston ($q_{piston}$), and pretest volume (ΔV).
- flowline pressure signal ($P_{fl}$), measured as a function of time, t;
- thermophysical properties of the tool and the fluid in the flowline (water or oil), namely: thermal conductivity (K), coefficient of thermal expansion (α), isobaric heat capacity ($c_P$), density (ρ), adiabatic compressibility ($\kappa_S$), isothermal compressibility ($\kappa_\Theta$), and tool compressibility ($c_{tool}$).

Starting with computations for a dry pretest simulation, in one embodiment the simulation of a false buildup is based on computations of flowline pressure and temperature as a function of time during a pretest for a flowline architecture. See, e.g., Betancourt et al., "Effects of Temperature Variations on Formation Tester Pretests", Soc. Pet. Eng Annual Technical Conference and Exhibition, Denver, Colo., SPE 146647 (2011) and Betancourt, "Some Aspects of Deep Formation Testing", PhD Dissertation, The University of Texas at Austin, http://repositories.lib.utexas.edu/handle/2152/ETD-UT-2012-05-5232 (2012) which are hereby incorporated by reference in their entireties herein. In one embodiment, the flowline architecture for which the simulation is generated substantially corresponds to the flowline architecture of the formation tester borehole tool from which pressure measurements are to be made.

For a dry test, $q_{piston}$ has a large influence on the time-dependent temperature and pressure. A large value of $q_{piston}$ is conducive to adiabatic conditions during drawdown, while an isothermal drawdown could be achieved with a low value of $q_{piston}$ Generally, pressure and temperature behavior during drawdown will lie between adiabatic and isothermal conditions because of heat conduction between the formation tester tool and the surrounding wellbore. After drawdown, heat conduction will eventually restore the initial flowline to the borehole temperature, i.e. $\Theta_{well}$.

Figure 1B:
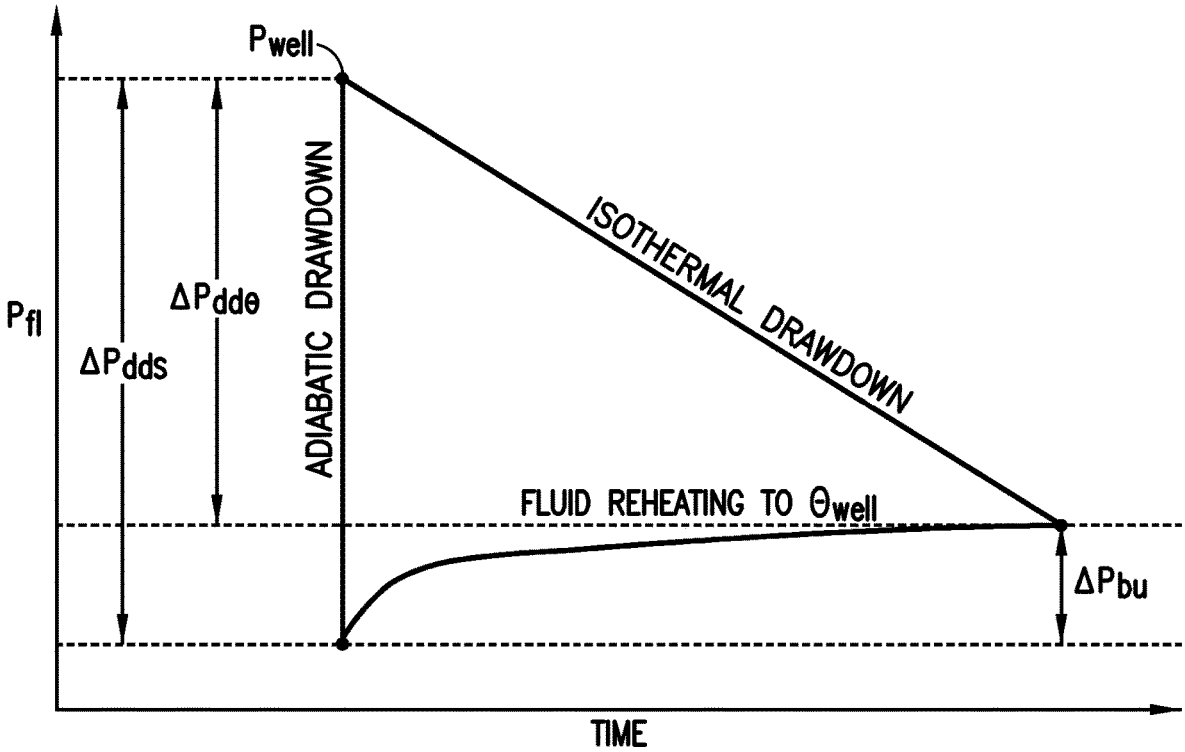
FIG. 1*b* illustrates an explanation of the equilibrium states of the pretest following a flowline volume increase ΔV when the probe of the formation tester of FIG. 1*a* is set against an impermeable formation and where the pressure changes $\Delta P_{ddS}$ and $\Delta P_{dd\Theta}$ correspond to adiabatic and isothermal drawdowns, respectively.

Turning to FIG. 1*a*, a formation tester tool 100 is shown in the borehole 110 of an impermeable formation 120. The formation tester tool 100 includes a probe 130, a flowline 135, a piston 140, and a pressure sensor 150. FIG. 1*b* illustrates an explanation of the equilibrium states of the pretest following a flowline volume increase ΔV generated by the piston 140 when the probe 130 is set against the impermeable formation 120. The pressure changes $\Delta P_{ddS}$ and $\Delta P_{dd\Theta}$ correspond to adiabatic and isothermal drawdowns, respectively. A thermodynamic analysis of the pressure and temperature behavior of the fluid in the flowline for the limiting case of an adiabatic drawdown on an impermeable formation yields the equilibrium values of pressure and temperature which are expected during a dry pretest. Of particular relevance are $\Delta P_{ddS}$, the magnitude of a drawdown of volume ΔV on an impermeable formation under adiabatic conditions, and $\Delta P_{bu}$ the magnitude of the pressure increase after the pretest piston stops:

$$\frac{\Delta P_{bu}}{\Delta P_{ddS}} = \frac{\kappa_S + c_{tool}}{\kappa_\Theta + c_{tool}} - 1 = \frac{1}{1 - \frac{c_{tool}}{k_\Theta}}\left(\frac{\kappa_S}{\kappa_\Theta} - 1\right), \tag{1}$$

where $$\Delta P_{ddS} \equiv P_{ddS} - P_{well} \approx -\frac{1}{\kappa_S + c_{tool}} \ln\left(\frac{V_{flowline} + \Delta V}{V_{flowline}}\right). \tag{2}$$

Figure 2:
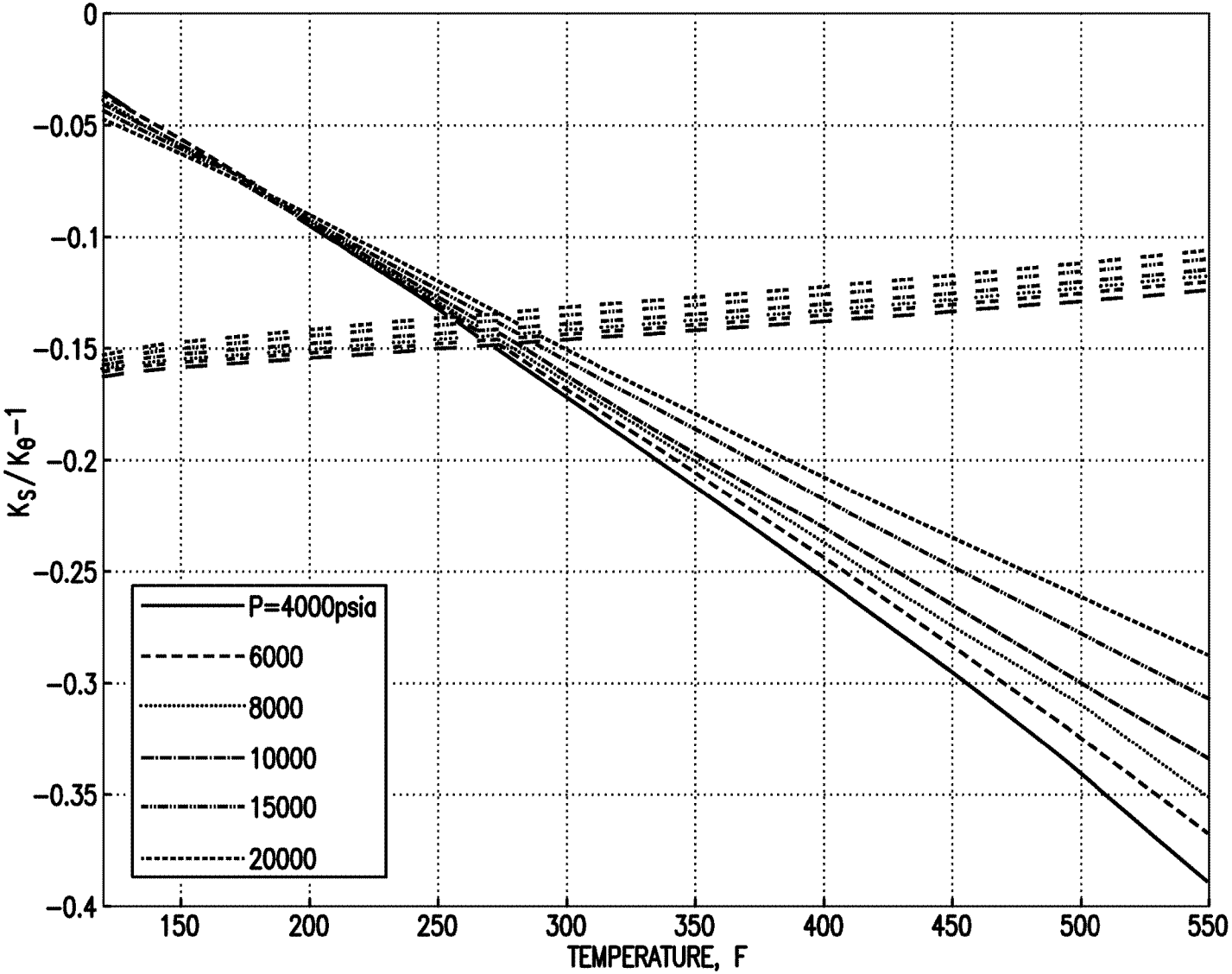
FIG. 2 illustrates the thermodynamic properties of water (solid lines) and n-hexadecane (dashed lines) used for the computation of the pressure increase during a false buildup.

According to equation (1), the fundamental cause of a false buildup is the difference between the isothermal compressibility $\kappa_\Theta$ and the adiabatic compressibility $\kappa_S$. For water and oil, fluids typically encountered in wells, the difference between $\kappa_t$ and $\kappa_S$ varies as pressure and temperature change, as seen in FIG. 2. It will be appreciated that after an adiabatic drawdown, heat conduction between the flowline and the wellbore will increase the flowline fluid temperature to $\Theta_{well}$. It can be shown that as temperature increases, the flowline pressure will increase towards the pressure that would have been achieved if the drawdown had occurred under isothermal conditions ($P_{well}-\Delta P_{dd\Theta}$) Hence, $\Delta P_{bu}=\Delta P_{ddS}-\Delta P_{dd9\Theta}$. FIG. 2 illustrates the thermodynamic properties of water (solid lines) and n-hexadecane (dashed lines) used for the computation of the pressure increase during a false buildup. See previously incorporated by reference, Betancourt et al. SPE 146647.

A simulation of the time-dependent flowline pressure and temperature for the case of a dry pretest is based on the coupled description of conservation of mass and energy in the tool flowline during a drawdown and buildup:

$$c_{eff} V_{flowline}\left(\frac{dP}{dt} - \alpha\frac{d\langle\Theta\rangle}{dt}\right) = q_{fm} - q_{piston}, \tag{3}$$

where $c_{eff} \equiv c_{tool}+\kappa_\Theta$ is the effective flowline compressibility, a is the coefficient of thermal expansion of the fluid in the flow line (typically the same fluid as in the wellbore, e.g., drilling mud), and $\langle\Theta\rangle$ is the mass-average temperature of the fluid in the flowline defined according to $$\langle\Theta\rangle \equiv \frac{\int_{flowline\ fluid} \rho\Theta dv}{\int_{flowline\ fluid} \rho du}, \tag{4}$$

According to one aspect, flowline pressure and temperature behavior depend on tool design; i.e., they are tool-specific. Given two tools with the same flowline volume but different flowline radii, the temperature will take longer time to equilibrate in the tool with the larger flowline radius. Complex tool designs, e.g., flowlines with various components with large radius variations, require a longer time to reach thermal equilibrium than a small, constant radius flowline, and consequently the flowline pressure during buildup requires a longer time to equilibrate. This delay is a consequence of different elements affecting the pressure signal at different times during buildup.

The equations of conservation of non-mechanical energy for the fluid in the flowline and the surrounding tool can be expressed by:

$$\rho_{fluid}\hat{c}_{Pfluid}\frac{\partial\Theta_i}{\partial t} - \alpha_{fluid}\Theta_i\frac{dP}{dt} = K_{\Theta fluid}\nabla^2\Theta, \quad 0 < r < r_{fli} \tag{5}$$

and, $$\rho_{solid}\hat{c}_{Psolid}\frac{\partial\Theta_i^*}{\partial t} = K_{\Theta solid}\nabla^2\Theta^*, \quad r_{fli} < r < r_{tool}, \tag{6}$$

where $\Theta$ is the temperature of the fluid within the flowline and $\Theta^*$ is the temperature in the region between the flowline wall and the tool wall. Conservation of non-mechanical energy is calculated for each flowline component. In one embodiment, while the flowline is typically a complex system consisting of various components such as valves, sensors and conduits of different sizes and dimensions, in the equations (5) and (6), flowline components are modeled as long cylinders, neglecting end effects, assuming heat conduction in the radial direction, no natural convection, and constant wellbore temperature.

It should be appreciated that formation tester performance can vary substantially depending on environmental conditions such as the type of drilling fluid in the wellbore, wellbore temperature and pressure overbalance. An increase in wellbore temperature and use of oil-based mud as drilling fluid, the fluid most commonly used in high temperature wells, exacerbate temperature effects on the buildup pressure because of the larger compressibility and longer time required to reach thermal equilibrium compared to water-based mud, even though for the latter the total temperature variation could be larger. The range of possible values of the relevant tool parameters and thermophysical properties of the fluids and tool materials have been thoroughly studied and may be found in previously incorporated Betancourt, "Some Aspects of Deep Formation Testing", PhD Dissertation, The University of Texas at Austin, http://repositories.lib.utexas.edu/handle/2152/ETD-UT-2012-05-5232 2012.

Turning now to the continuous real-time computation of sandface pressure, the streaming pressure data recorded during the buildup is analyzed in real-time to predict the equilibration pressure, as follows. This analysis starts with the statement of conservation of mass in the flowline, assuming isothermal conditions, and modeling the formation flow of formation fluid into the tool ($q_{fm}$), neglecting the compressibility of the formation (quasi-steady state approximation):

$$\begin{aligned} c_{eff} V_{flowline}\left(\frac{dP}{dt}\right) &= q_{fm} - q_{piston} \\ &= 4r_{probe}\frac{k}{\mu}(P_{sand} - P_{fl}) - q_{piston} \end{aligned} \tag{7}$$

After grouping terms:

$$C\left(\frac{dP}{dt}\right) = D(P_{sand} - P_{fl}) - q_{piston}(t), \tag{8}$$

where $C \equiv x_{eff}V_{flowline}$, and $D \equiv 4r_{probe}\ k/\mu$ where $r_{probe}$ is the radius of the probe orifice. During build up $q_{piston}$ (t)=0. Furthermore, it is assumed that C and D are constants. Equation (8) can be expressed as:

$$P_{sand} = \frac{C}{D}\left(\frac{dP_{fl}}{dt}\right) + P_{fl}. \tag{9}$$

Differentiating with respect to time, and using $dP_{sand}/dt=0$ yields $$-\frac{D}{C} = \frac{1}{\frac{dP_{fl}}{dt}}\frac{d}{dt}\left(\frac{dP_{fl}}{dt}\right) = \frac{d}{dt}\left(\ln\frac{dP_{fl}}{dt}\right). \tag{10}$$

To compute the sandface pressure using the pressure signal during buildup, equation (10) is substituted into equation (9), giving:

$$P_{sand} = P_{fl} - \frac{\frac{dP_{fl}}{dt}}{\frac{d}{dt}\left(\ln\frac{dP_{fl}}{dt}\right)}. \tag{11}$$

Using equation (11) it is possible to estimate the sandface pressure, $P_{sand}$, at any time using the pressure signal, $P_{fl}$, and its time derivative. It is to be expected that $P_{sand}$ should have a constant value. Variations indicate that the model of the pretest is not valid and hint to problems with the pretest. Also, uncertainty (noise) in the signal could lead to non-constant, time-dependent estimates of $P_{sand}$.

Once the sandface pressure is known, according to one embodiment, the formation mobility can be computed according to:

$$\frac{k}{\mu} = \frac{1}{4r_{probe}}\frac{\int_{t1}^{T} q_{piston}\,dt}{\int_{t1}^{t2}[P_{sand} - P_{fl}]dt}. \tag{12}$$

Figure 3:
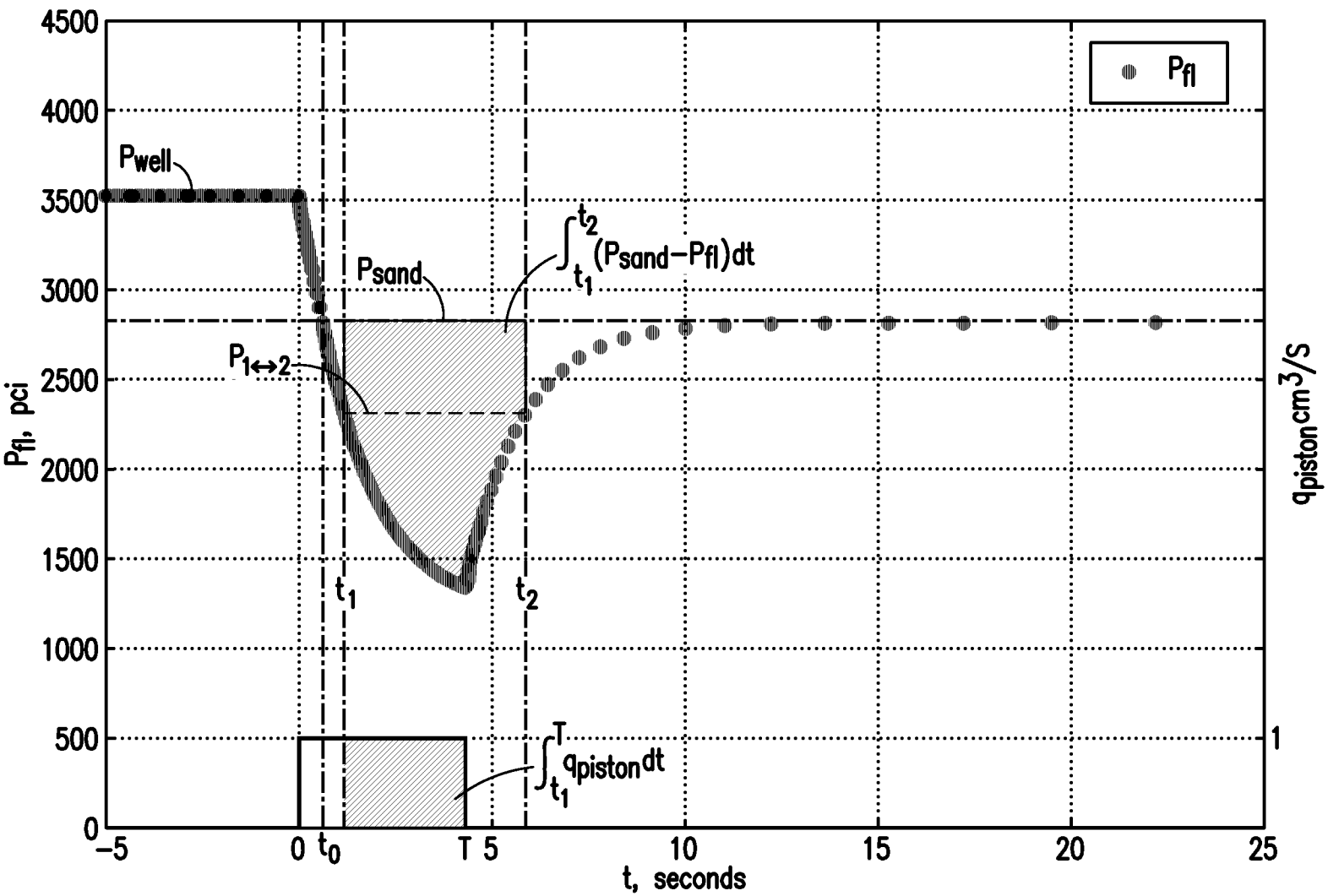
FIG. 3 depicts the definitions of time and pressure limits for computation of formation mobility.

The theoretical basis of equation (12) was described by Dussan, "A Robust Method for Calculating Formation Mobility with a Formation Tester" SPE Reservoir Evaluation and Engineering, pages 239-247, April 2011, which is hereby incorporated by reference herein in its entirety. The definitions of $t_1$, $t_2$, and T are shown in FIG. 3. In particular, $t_2$ is the time of the most recent flowline pressure measurement during buildup, and $t_1$ is the time in the drawdown period when the pressure $P_{fl}$ is equal to $P_{fl}$ at $t_2$; this pressure is denoted $P_{1\leftrightarrow 2}$ in FIG. 3. The time when the pretest piston stops (end of the drawdown period) is T. In one embodiment, mobility (k/μ) is computed for each value of $t_2$ until the end of the pretest, and is expected to stabilize to a constant value if $P_{fl}$ obeys this model. FIG. 3 depicts the definitions of time and pressure limits for computation of formation mobility.

In one embodiment, flowline compressibility can also be computed in real time as a quality control indicator according to $$c_{eff}V_{flowline} = C = \frac{\int_{t1}^{T} q_{piston}\,dt \int_{T}^{t2}(P_{sand} - P_{fl})d\bar{t}}{\int_{t1}^{t2}(P_{sand} - P_{fl})dt(P_{1\leftrightarrow 2} - P_{fl}(T))}. \tag{13}$$

It is expected that $c_{eff}$ should have a constant value, and variations indicate that $P_{fl}$ is not obeying the model. For example, for certain formation tester tools of Schlumberger such as the previously-referenced MDT™, typical values of $c_{eff}$ are known to be between $5\times10^{-6}$ and $10^{-5}$ $psi^{-1}$, and deviations from this range could be an indication of deterioration in the tool performance. It is noted that Equation (13) was obtained from the definition of D, equation (12), and an integration of equation (9) over the buildup time $\int_{t0}^{t2}(P_{sand}-P_{fl})\,d\bar{t}\int_{P_{fl}(T)}^{P_{1\leftrightarrow 2}} C/D\,dP_{fl}$, where $P_{1\leftrightarrow 2}=P_{fl}(t_2)$ is the present value of the pressure signal.

With the ability to simulate time-dependent flowline pressure and temperature for the case of a dry pretest, and the ability to determine sandface pressure from the flowline pressure signal and its time derivative, various interpretation protocols may be set. In one embodiment, a bad seal is declared (i.e., the pretest should be terminated because the probe seal is ineffective) if the predicted sandface pressure reaches a value that is within a prescribed value (e.g., 2% of the wellbore pressure), and remains constant or increasing for a certain length of time (e.g., 120 seconds). A decision may be made at this point to attempt a new test at a nearby location or to reset the probe seal. It will be appreciated that the prescribed value may be a different value, and the length of time may be a different length of time. Also, in one embodiment, a dry test is declared (i.e., the pretest should be terminated because the drawdown failed to establish hydraulic contact between the flowline and the formation) if the measured flowline pressure signal follows the behavior of the simulated false buildup within a prescribed value (e.g., 2%) or is below that value for a reasonable length of time (e.g., 120 seconds). Again, the prescribed value may be a different value, and the length of time may be a different length of time.

Figure 4:
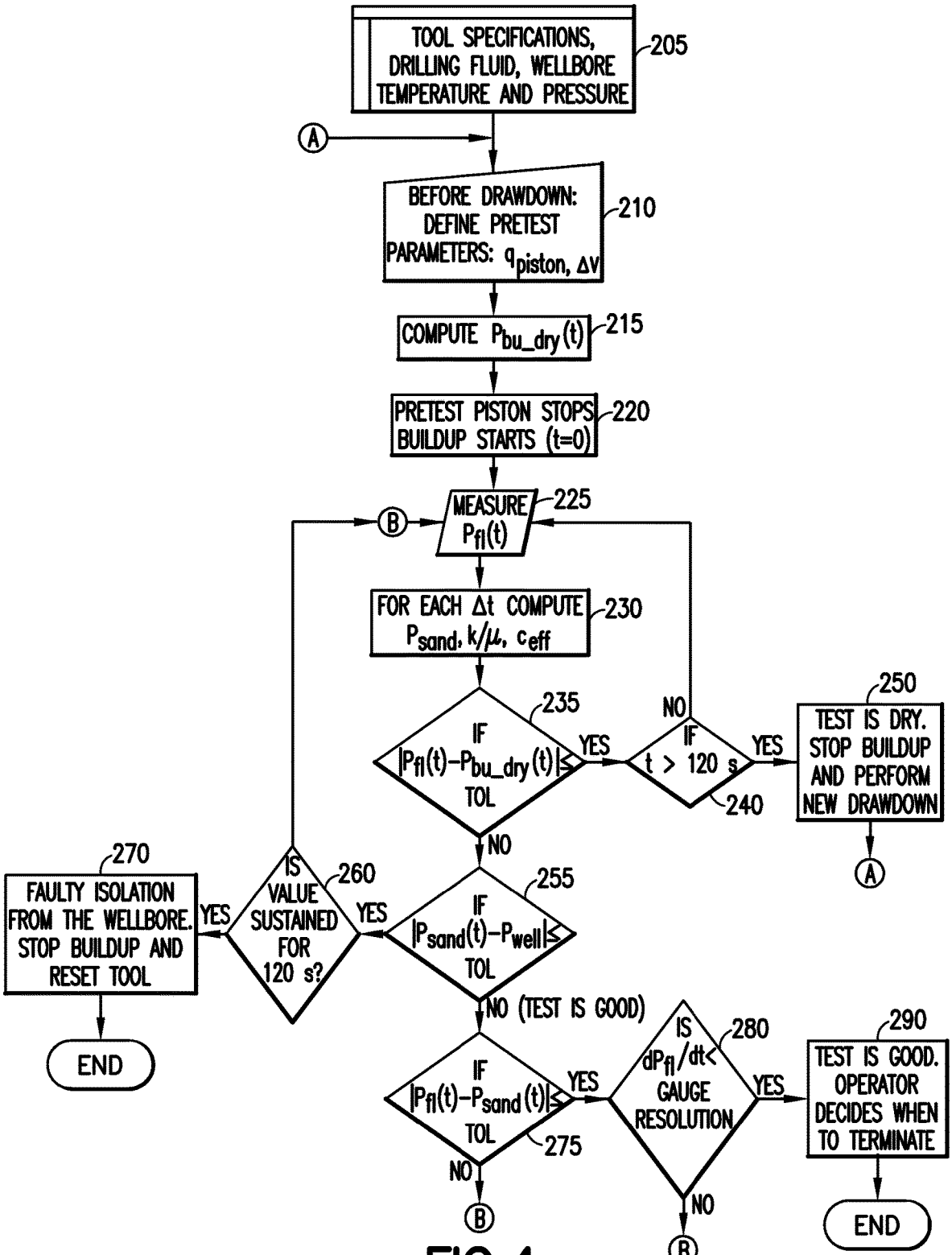
FIG. 4 illustrates a flow chart of an embodiment of the subject disclosure.

One embodiment of a protocol for determining whether to terminate a pretest is depicted in FIG. 4. At 205, information is gathered regarding tool specifications, the drilling fluid, the wellbore temperature and the wellbore pressure. At 210, prior to drawdown, pretest parameters such as piston speed ($q_{piston}$) and pretest volume (ΔV) are defined. At 215 (either prior to the pretest or during the pretest) the pressure curve for a dry buildup $P_{bu,dry}$ (t) is computed by simultaneously solving equations (3) (6) and $P_{bu,dry}$ may be plotted versus time. At 220, the pretest is conducted and when the pretest piston stops, buildup starts, thereby defining t=0. At 225 the pressure signal $P_{fl}$ is measured over time and may be plotted. At 230, over a plurality of time intervals Δt, the sandface pressure $P_{sand}$ is computed using equation (11), and may be plotted. In addition, formation mobility and effective flowline compressibility may be computed at 230. Decisions are then made on the quality of the pretest depending on the relative behavior of the three variables $P_{bu,dry}$ (computed at 215), $P_{fl}$ (measured at 225), and $P_{sand}$ (computed at 230).

More particularly, in one embodiment, at 235, a determination is made as to whether $P_{fl}$ is similar to or tracking $P_{bu_dry}$ (e.g., whether the absolute value of the difference is within a threshold or tolerance). This may be accomplished by comparing number values or by comparing graphs (plots). If so, at 240, the length of time of this condition is assessed. If this condition is present for a short amount of time, testing continues in a loop of 225, 230, 235 until either the condition is not present, or until a predetermined length of time (e.g., 120 seconds) has passed. If the condition continues past the predetermined length of time, at 250 the pretest is declared "dry". The buildup is stopped and if desired, a new drawdown is started. Alternatively, the tool may be moved. However, if at 235 the difference is beyond the threshold, at 255, a determination is made as to whether the sandface calculated pressure $P_{sand}$ is similar to the borehole pressure $P_{well}$ (i.e., whether the absolute value of the difference is within a threshold or tolerance). If the sandface and borehole pressures are close, at 260, the length of time of this condition is assessed. If this condition is present for a short amount of time, testing continues in a loop of 260, 225, 235, 255 until either the condition is not present or until a predetermined length of time (e.g., 120 seconds) has passed. If the condition continues past the predetermined length of time, at 270, then a faulty isolation from the wellbore is declared. The buildup is stopped, and the tool is either reset or moved. However, if at 255 the difference is beyond the threshold, at 275, if desired, a determination is made as to whether the difference between the measured pressure signal $P_{fl}$ and the calculated sandface pressure is less than a threshold value or tolerance. If the difference is greater, testing may continue in a loop of 225, 230, 235, 255, 275. If the difference is below the threshold, at 280*a* determination may be made as to whether a time derivative for the measured pressure signal is less than the gauge resolution. If not, testing continues in a loop of 225, 230, 235, 266, 275, 280 until such time as it is within the gauge resolution. Then, at 290 the test is declared "good", and the operator decides when to terminate the test.

It should be appreciated that different thresholds or tolerances may be utilized at 235, 255, and 275. Likewise, different time values can be used at 240 and 260. Further, the order of the comparisons and loops can be changed. In addition, in some embodiments, only one comparison (e.g., the "dry" test or the "faulty isolation" test) is made. Further yet, comparisons such as made at 275 and 280 may not be made.

Example #1

Figure 5:
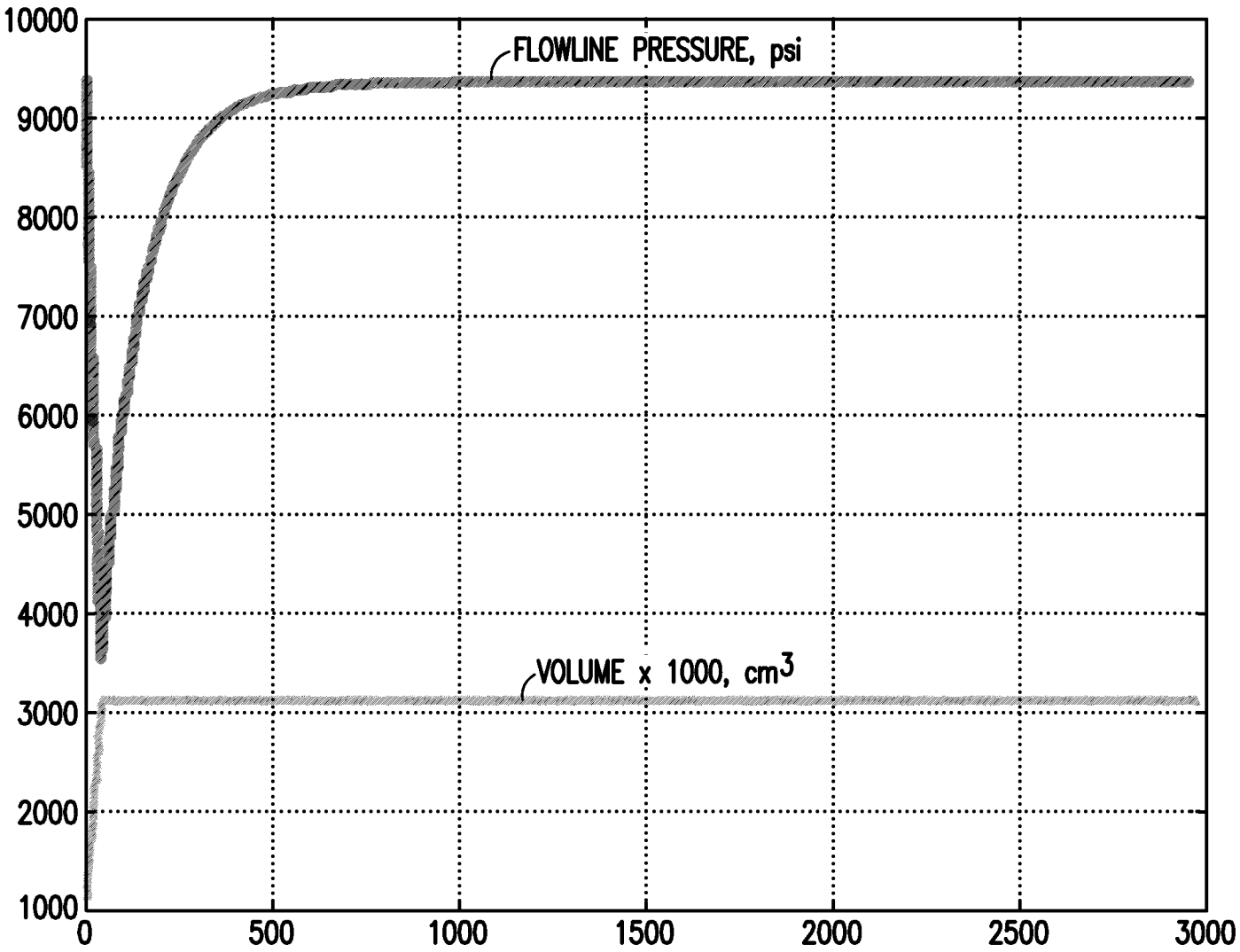
FIG. 5 depicts the flowline pressure and volume log for a test in a well filled with water.

Example 1 corresponds to a measurement with an actual tool conducted in a well filled with water, i.e., there is no mudcake. Therefore, it is known that the pressure signal will equilibrate to the wellbore pressure. The flowline pressure log and flowline volume log are presented in FIG. 5. In this example the formation mobility is known to be 0.015 mD $cp^{-1}$.

Figure 6:
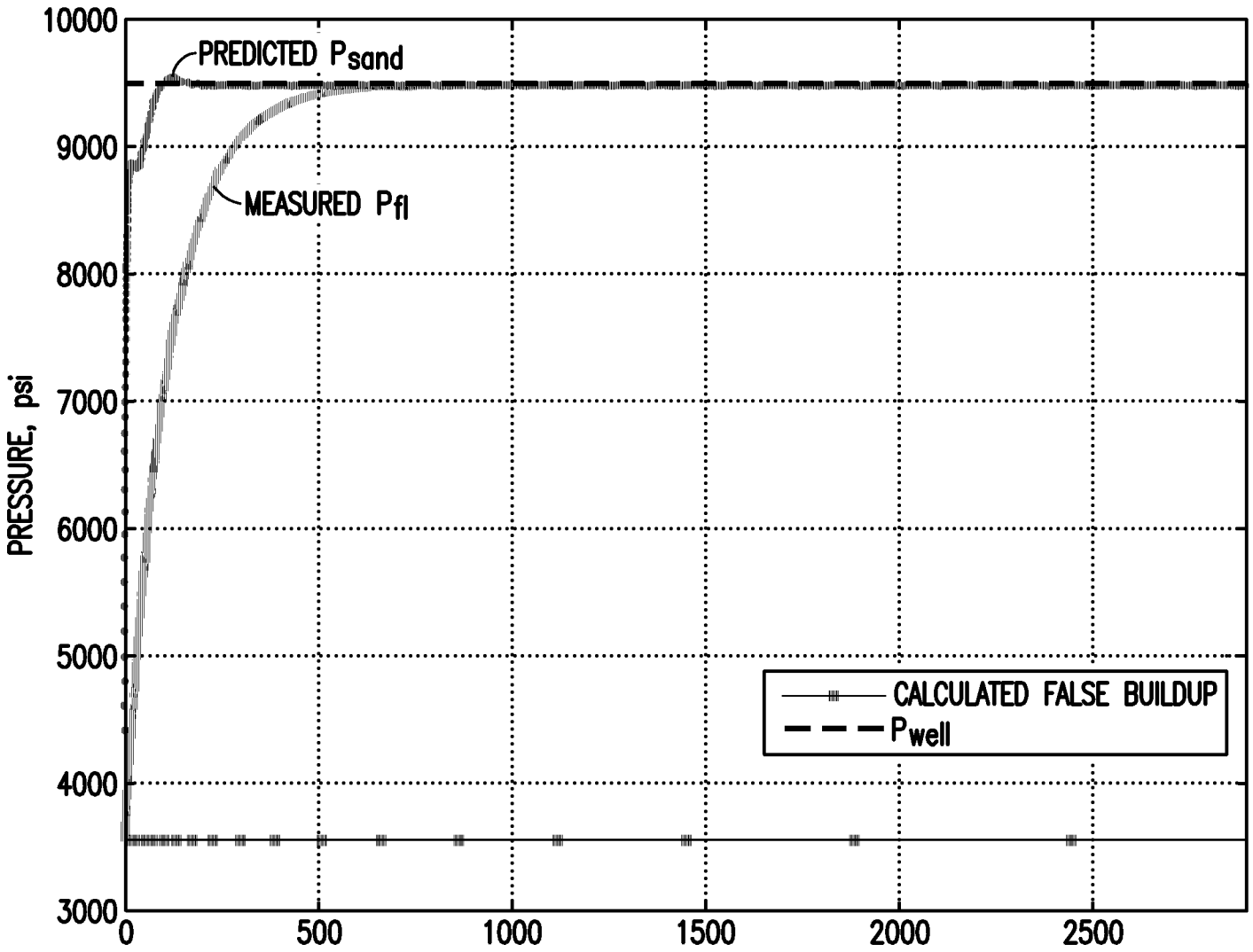
FIG. 6 illustrates the pressure analysis for Example 1 of the subject disclosure.

The predicted sandface pressure for this test is shown in FIG. 6 along with the measured pressure signal and the simulated false buildup caused by thermal variations. At around 100 seconds the real-time sand-face pressure curve begins indicating the sandface pressure to equal the borehole pressure $P_{well}$. At this time, the measured pressure has risen to about 50% of its ultimate change in value, but based on the sandface pressure, it is possible to know that the measured pressure will equilibrate to a value very close to the wellbore pressure. In this case there is a large difference between the false buildup simulation and the measured pressure signal.

Figure 7:
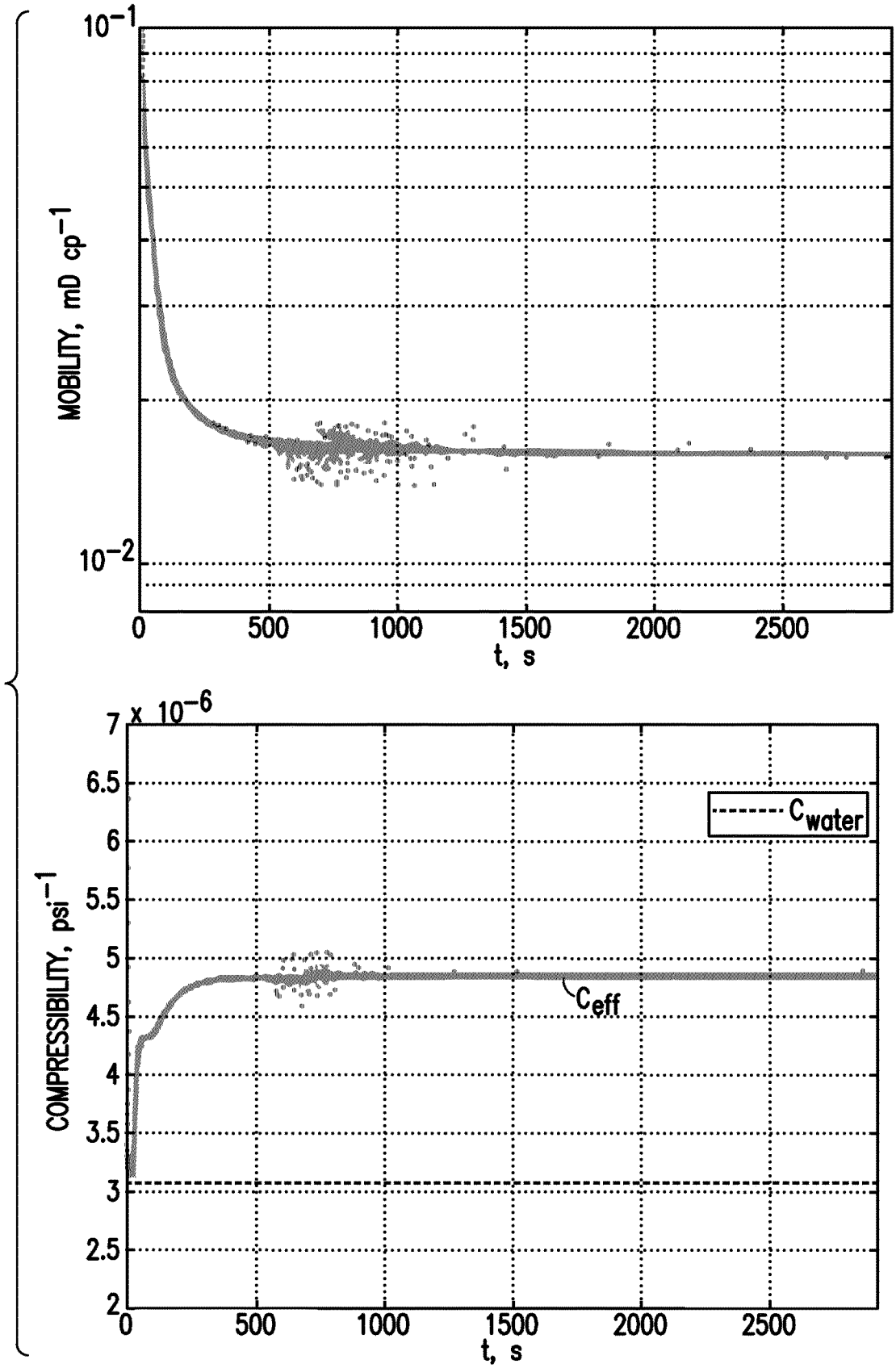
FIG. 7 illustrates the computation of mobility and compressibility for Example 1 of the subject disclosure.

The real-time computation of formation mobility shown in FIG. 7 (top) indicates that at 100 seconds the mobility ($k/\mu$) is about 0.03 mD $cp^{-1}$, asymptotically reaching a value of 0.016 mD $cp^{-1}$, which compares very well with a core measured value of 0.0145 mD $cp^{-1}$. The effective flowline compressibility, $c_{eff}$, shown in FIG. 7 (bottom) stabilizes at a value of $4.9\times10^{6}$ $psi^{-1}$, which is within the range of normal values for this tool. The progress of a plot, such as the one shown in FIG. 6, is monitored and evaluated in real time as pressure data are collected to make an assessment of the quality of the measurement.

Example #2

Figure 8:
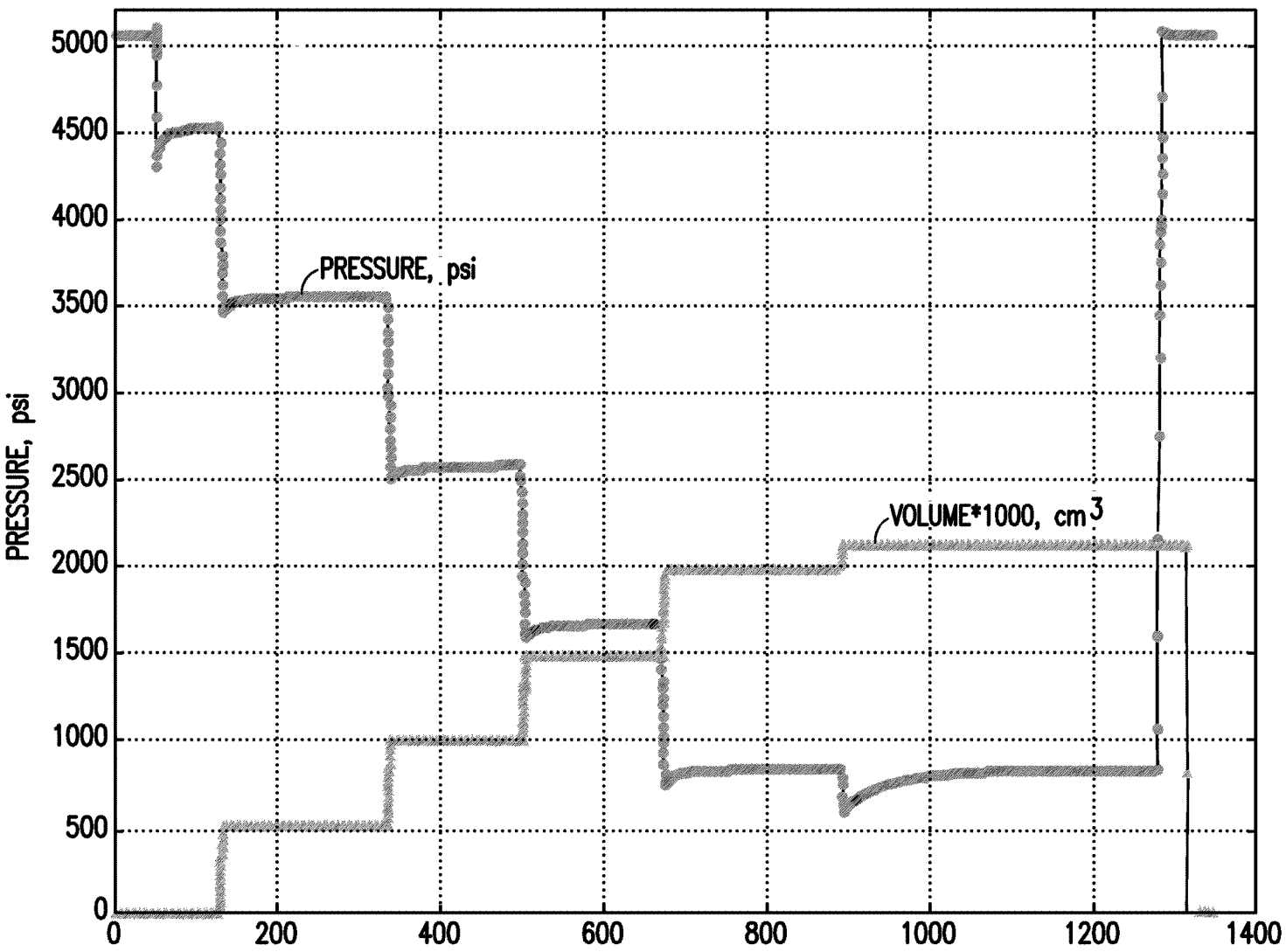
FIG. 8 illustrates the pressure and volume log for Example 2 of the subject disclosure.

Example 2 corresponds to a field log shown in FIG. 8. This dataset was acquired in a well drilled with an oil-based mud. The wellbore temperature was 260° F. at the station depth. In this case, the formation pressure, $P_{sand}$, is very low, 816.46 psi, and there is a large pressure overbalance ($P_{well}$ $P_{sand}$=4267 psi). A total of five drawdowns were performed at this station, identified by the changes in flowline volume increasing in increments of 0.5 $cm^3$. The first drop in pressure, at 50 seconds, is a consequence of the volume added to the flow line by the filter-valve piston stroke that occurs when setting the probe against the formation. Three drawdowns (initiated at 130, 335, and 498 seconds) were performed before making hydraulic contact with the formation fluid. It is known that these first three tests are dry because the last two drawdowns (initiated at 671 and 890 seconds) equilibrate to a very similar pressure, thus establishing $P_{sand}$.

Figure 9A:
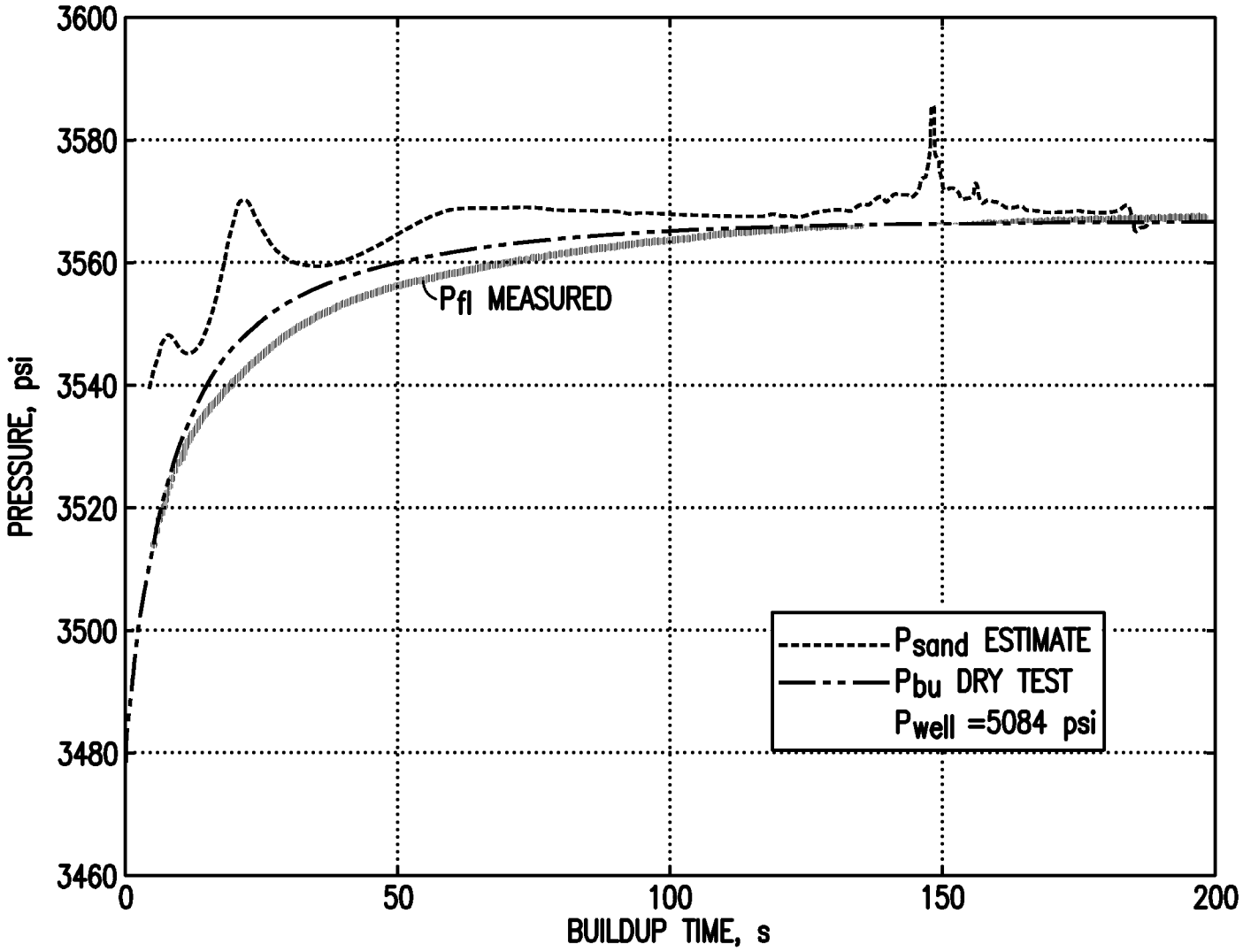
FIGS. 9*a*-9*c* depict the results of the analysis of the pressure behavior, and computed mobility and compressibility for the first dry test of FIG. 8.
Figure 9B:
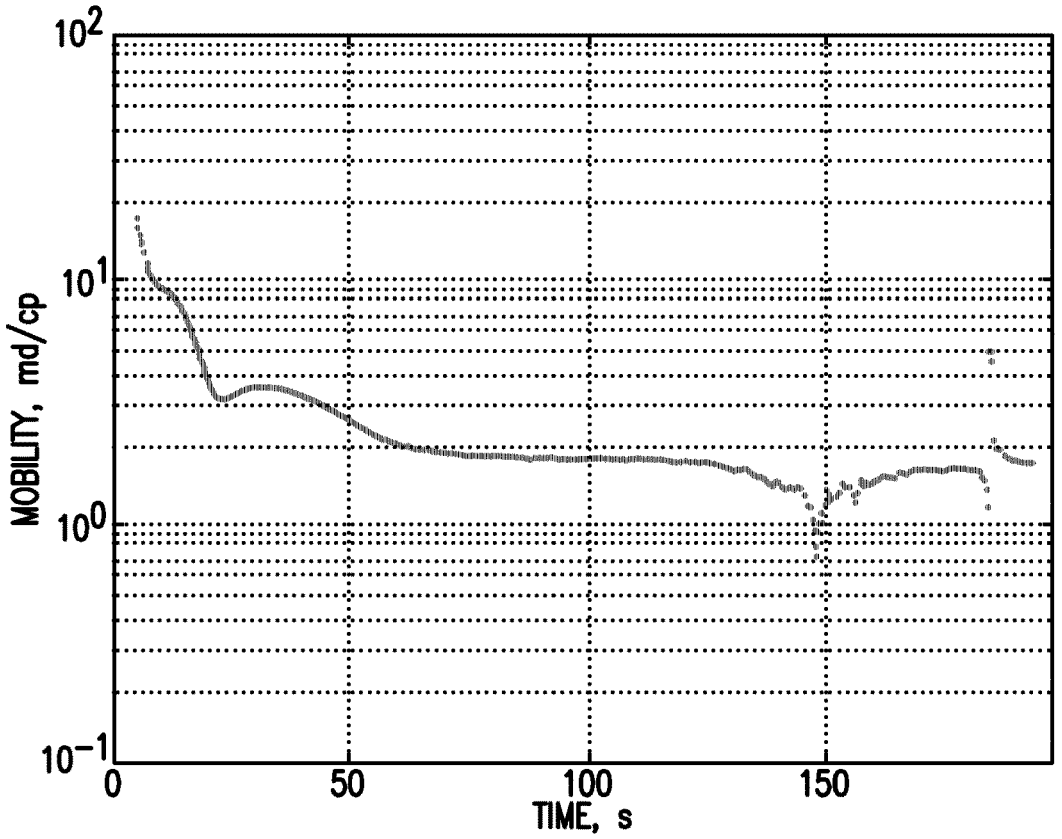
Figure 9C:
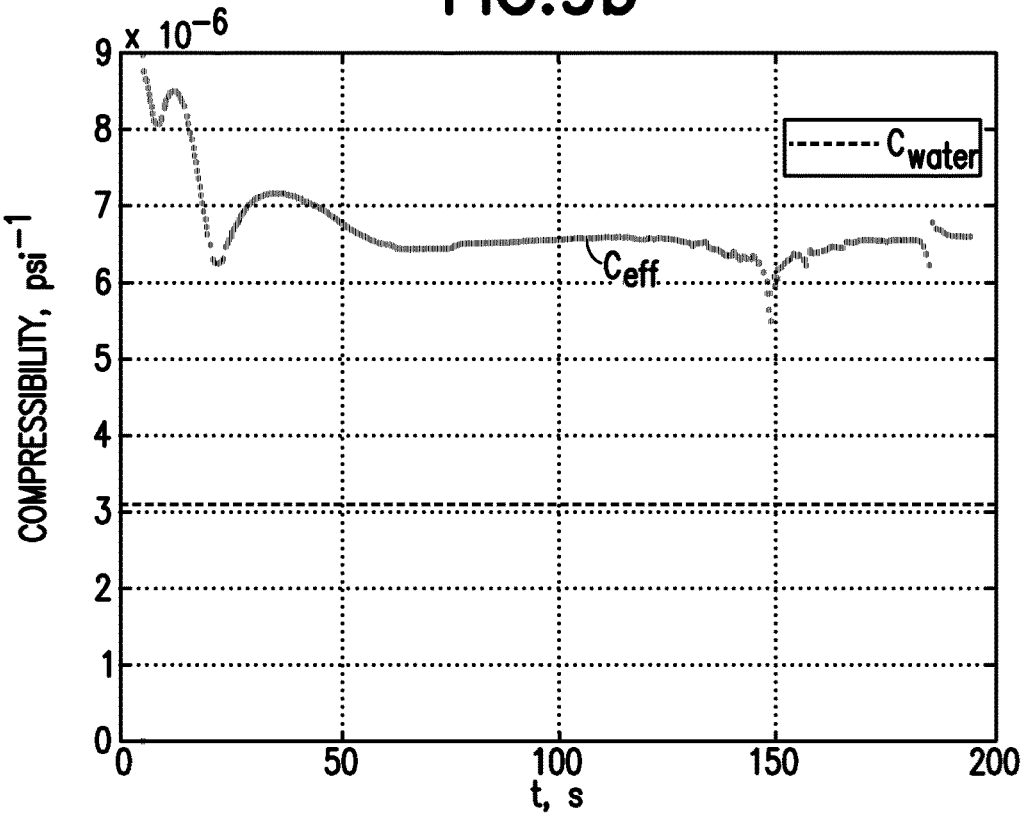

The simulated false buildup (dry test) is plotted in FIG. 9*a* for the first buildup in FIG. 8 (starting around 130 seconds), along with the measured pressure signal $P_{fl}$ and the estimated sandface pressure $P_{sand}$. As seen in FIG. 9*a*, the measured pressure signal is very similar (closely tracks) to the false buildup, calculated using $c_{tool}=8\times10^{-6}$ $psi^{-1}$, suggesting that the buildup is most likely caused by the temperature transient induced by the drawdown for an impermeable formation. Formation mobility and compressibility, calculated from equations (12) and (13), are shown in FIGS. 9(*b*) and 9(*c*). The calculated values of compressibility $c_{eff}$ are much larger than normal values for this formation tester, indicating that this test does not follow the physical model describing formation flow.

The conclusion could be drawn that this buildup is likely caused by thermal transients in the flowline, and therefore the decision to terminate the buildup could have been made within 60 seconds, shortening the waiting time significantly. The real time pressure analyses (not shown) of the second and third drawdown in FIG. 8 exhibit a similar behavior to that shown in FIG. 9*a*.

Figure 10A:
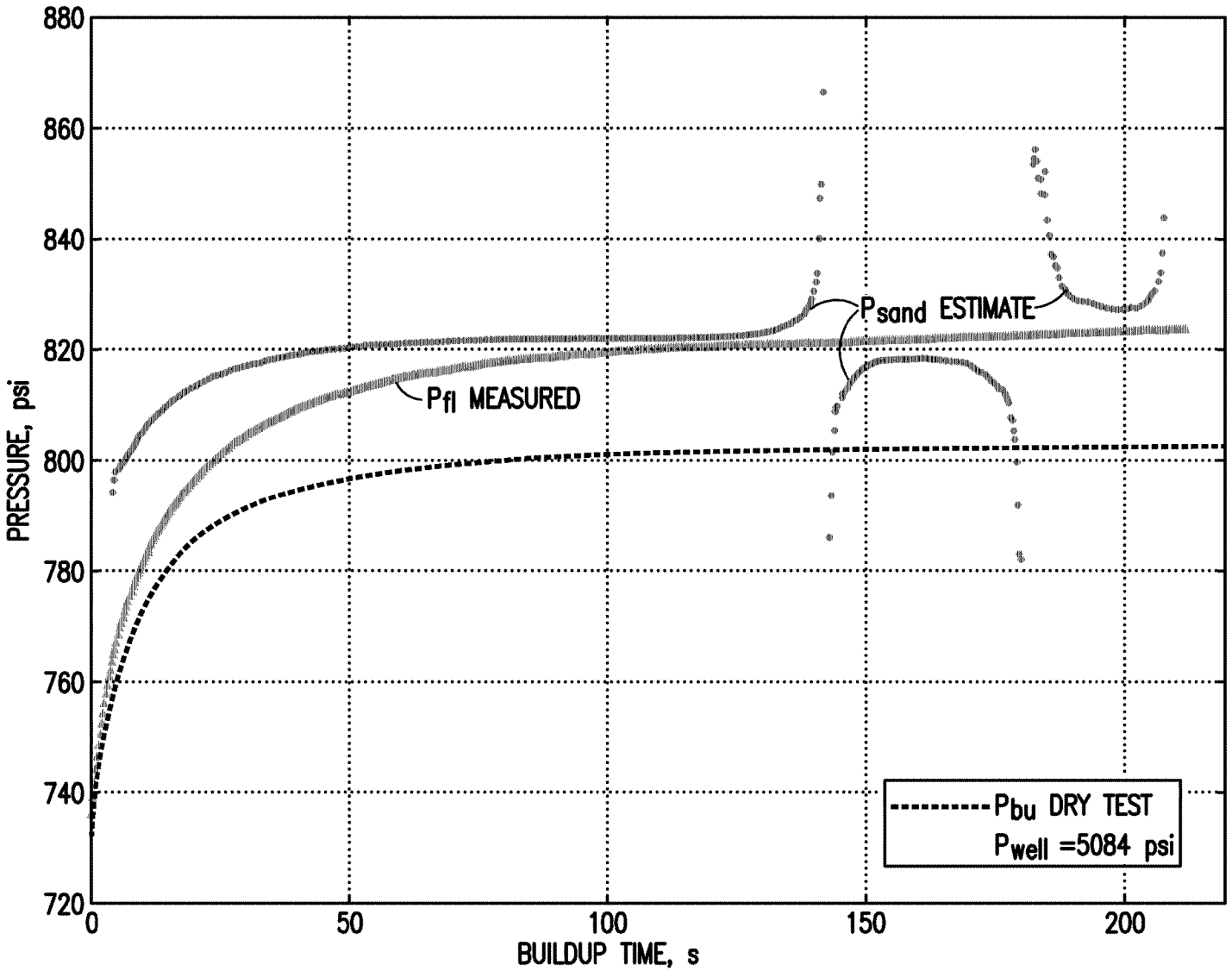
FIGS. 10*a*-10*c* depict the analysis of the 4th buildup of FIG. 8.
Figure 10B:
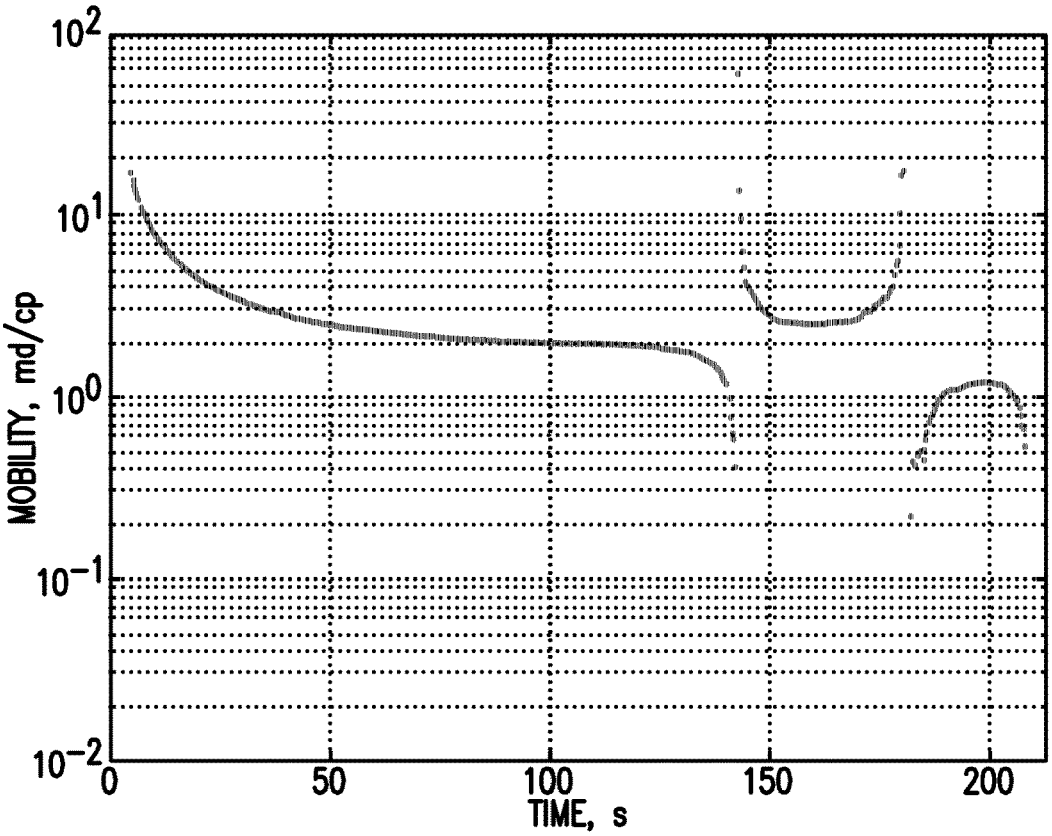
Figure 10C:
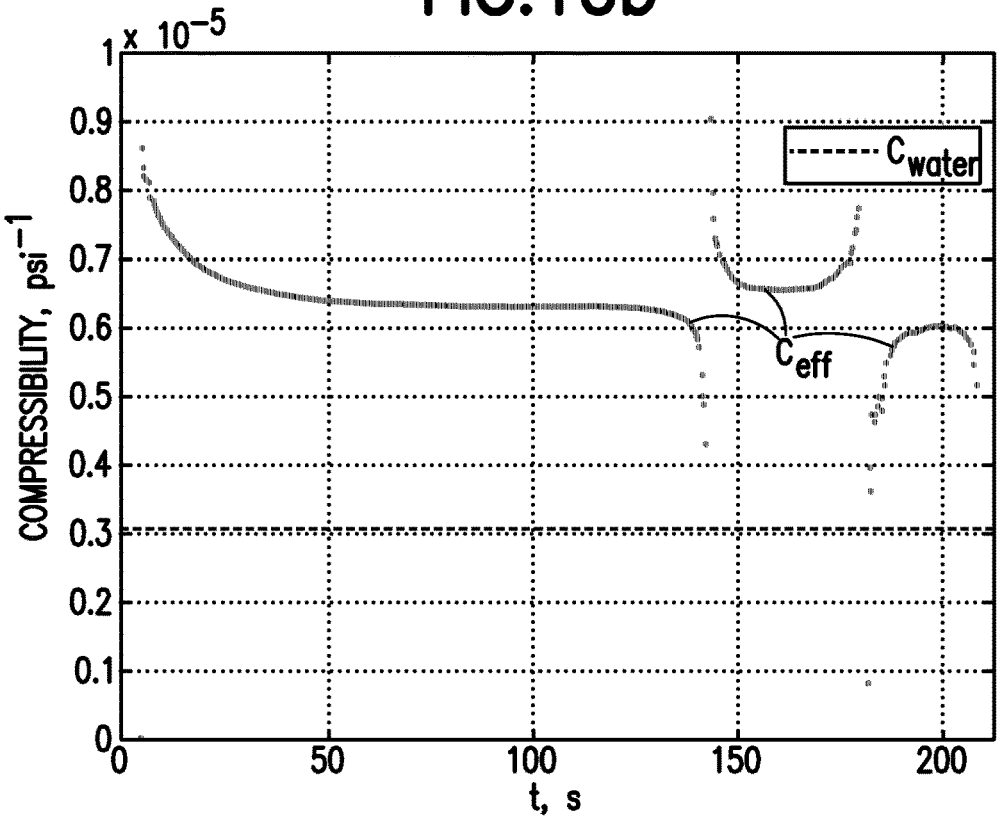

FIG. 10 shows the plots associated with the fourth drawdown, initiated at 671 seconds in FIG. 8. The pressure plot of FIG. 10*a* differs from the dry test shown in FIG. 9*a*. In this case it is known that hydraulic communication with the formation fluid was established during drawdown because the pressure at the end of the buildup is in agreement with that of the fifth and final buildup. Even though the final drawdown pressure is lower than the sandface pressure, the difference is about 85 psi, and the pressure response appears to be affected by the mudcake. Here the measured pressure signal is greater than the calculated false buildup signal, but the difference between these two curves is not as large as in Example 1 (FIG. 6). The anomaly observed in the calculated sandface pressure $P_{sand}$ between 140 and 180 seconds, is caused by an inflection in the measured pressure, possibly caused by the mudcake. The computed mobility seen in FIG. 9*b* and compressibility seen in FIG. 9*c* have similar values to the case of the dry test, raising questions on the quality of the test. Even though the pressure at the end of the buildup is very close to $P_{sand}$, it may be concluded that this test is not entirely successful because the drawdown is about 85 psi below $P_{sand}$ and it is quite possible that there is some interference from the mudcake.

Figure 11A:
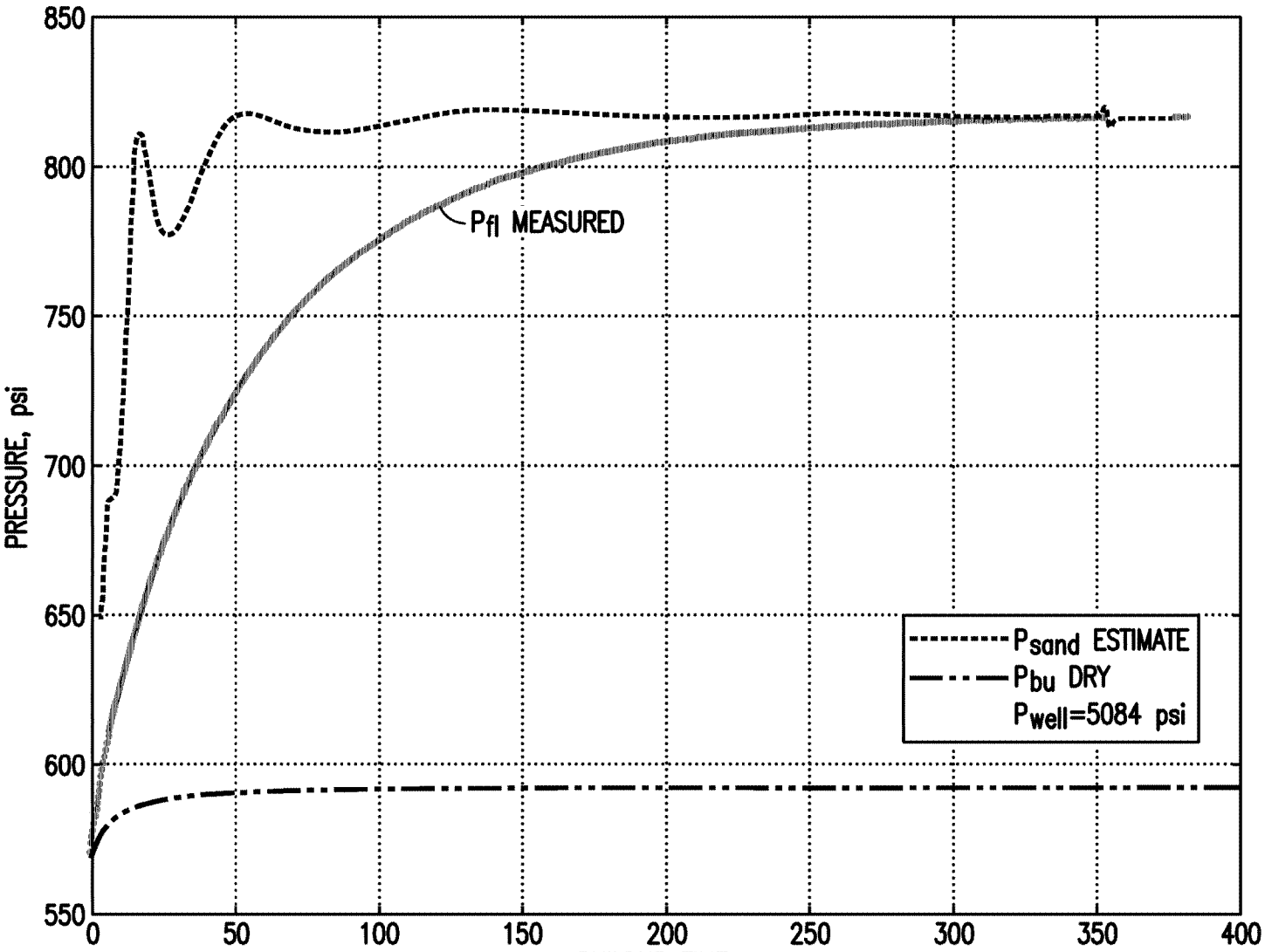
FIGS. 11*a*-11*c* depict the results of the analysis of the 5th buildup in FIG. 8.
Figure 11B:
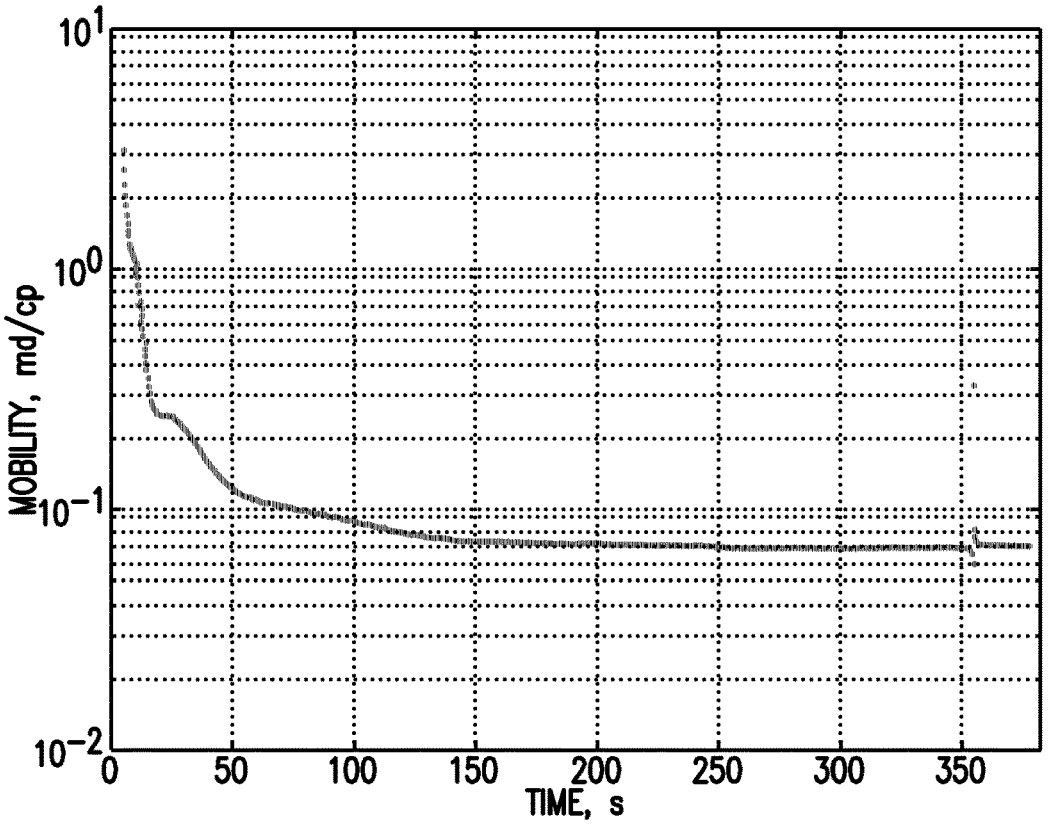
Figure 11C:
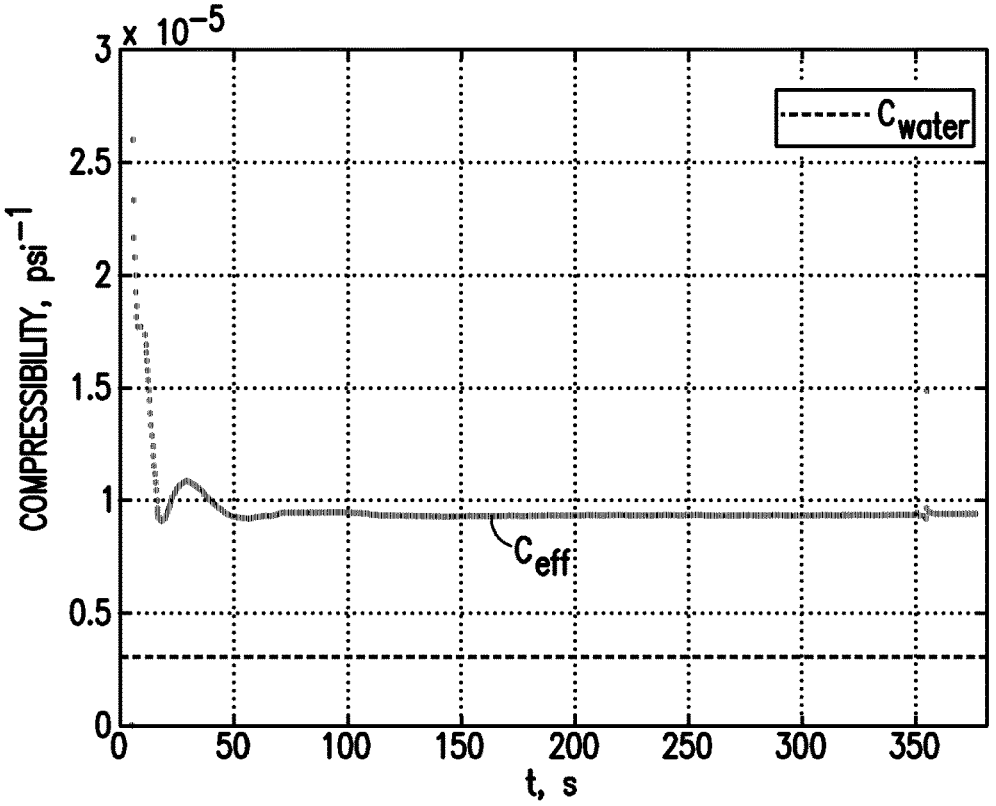

The analysis of the buildup pressure for the last drawdown performed in this test, around 890 seconds in FIG. 8, is shown in FIG. 11*a*. In this case the drawdown volume is smaller than the previous tests; nevertheless, the total pressure buildup is larger. From the analysis, a significant difference is obtained between the measured pressure $P_{fl}$ and the simulated dry test, indicating that this is clearly not a dry test. Also, the computed sandface pressure $P_{sand}$ starts to exhibit an almost constant behavior after 50 seconds. The computed values of mobility of FIG. 11*b* is different than in the previous tests in this log, and the computed values of compressibility $c_{eff}$ of FIG. 11*b* is within the range of normal values for this tool.

Example #3

Figure 12:
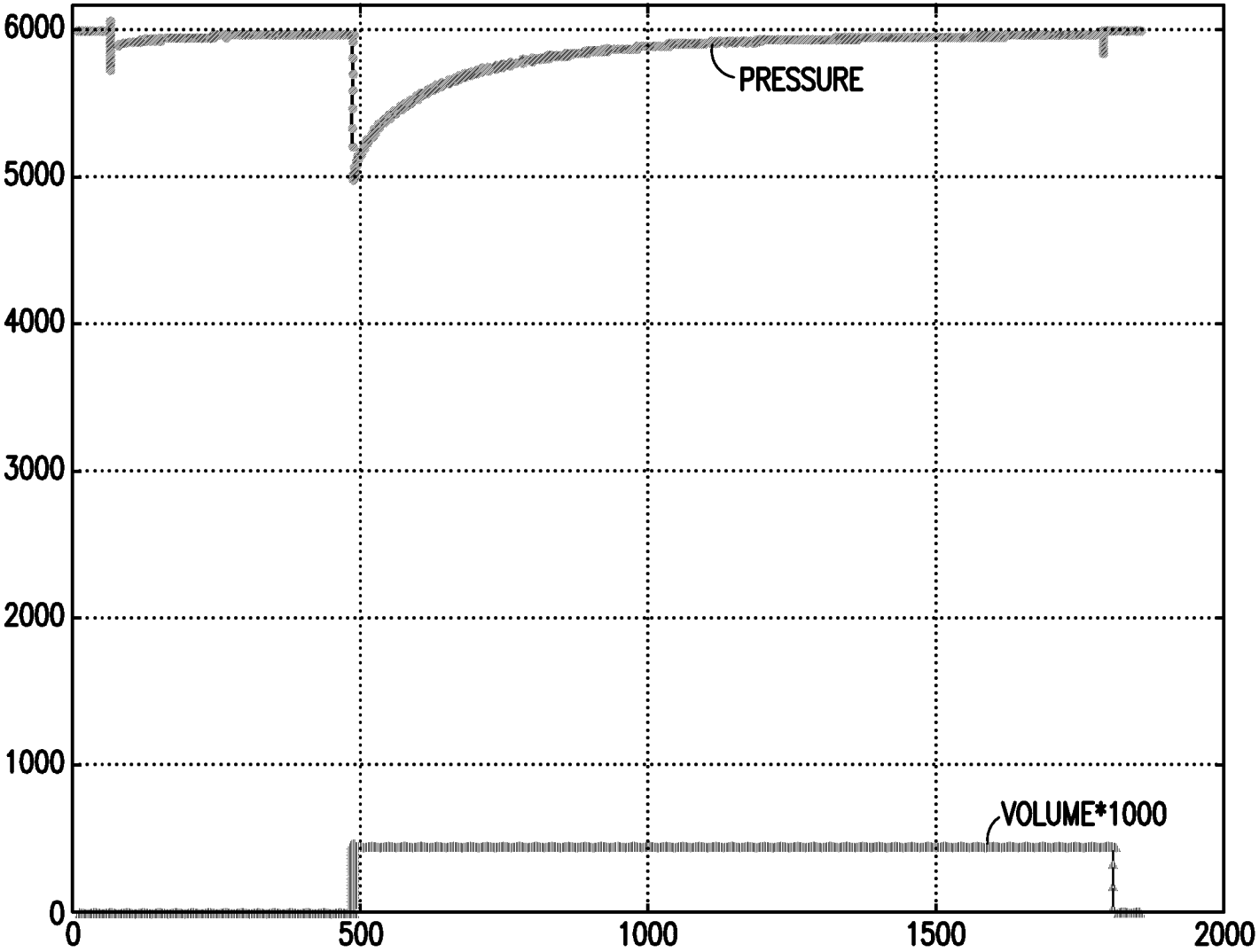
FIG. 12 depicts the pressure (psi) and volume ($cm^3 \times 1000$) log for Example 3 of the subject disclosure.

Example 3 corresponds to the log shown in FIG. 12. This test was acquired in a well drilled with a water-based mud, and the wellbore temperature at the tool station depth was 170° F. From a visual examination of the log, it is seen that after drawdown the pressure signal equilibrates slowly to a value that is very close to $P_{well}$, the wellbore pressure. In total, the buildup took about 1300 seconds (21 minutes). The entire test took about 30 minutes from beginning to end. As will be suggested from an analysis of the buildup, in this case it is not possible to distinguish whether $P_{sand}$ is similar to $P_{well}$ or whether there is a small leak in the seal around the probe. The fact that two other logs in the immediate vicinity of this one had problems with sealing around the probe hints that the small leak is most probable.

Figure 13A:
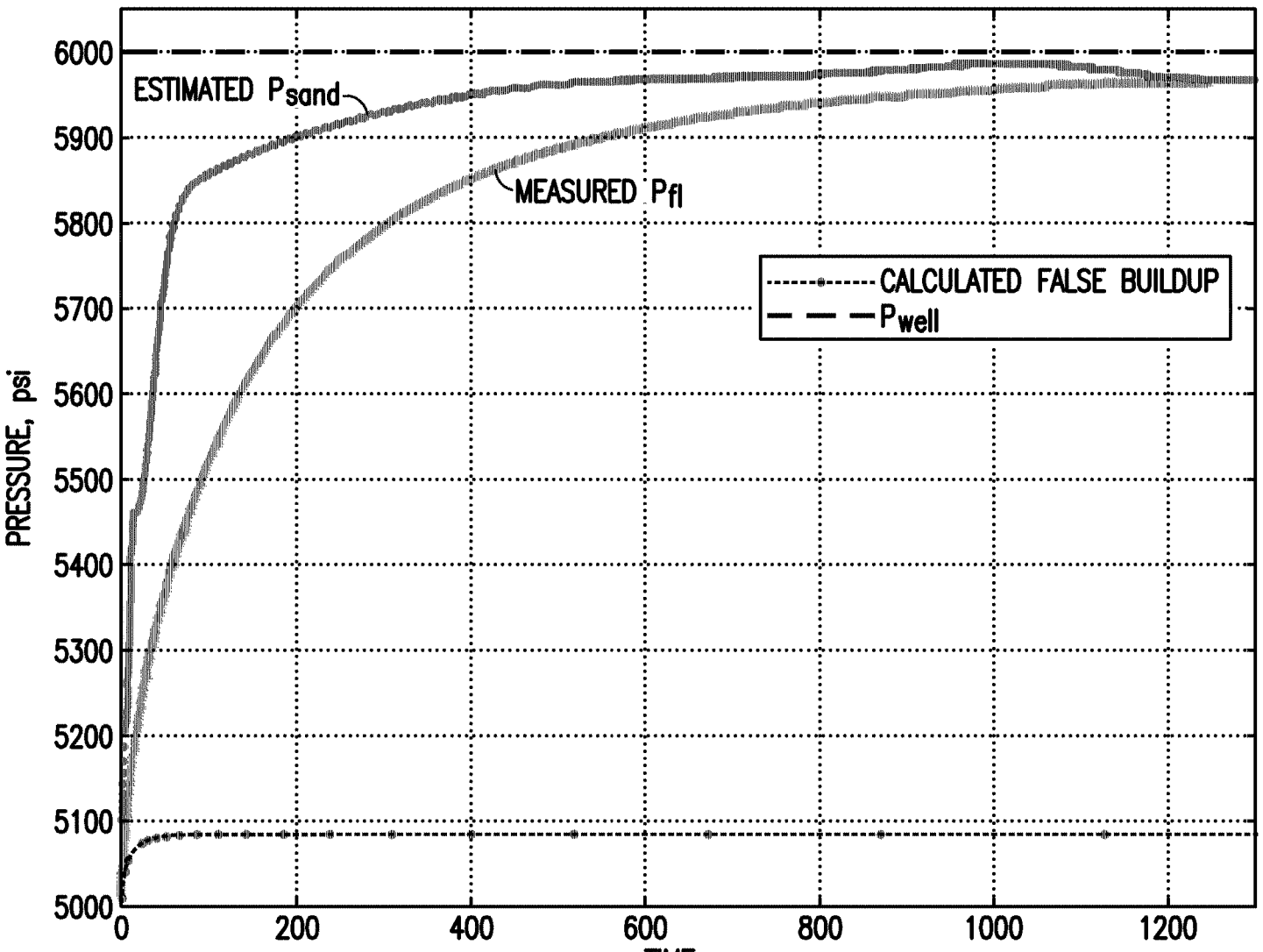
FIGS. 13*a*-13*c* depict the results of the pressure analysis for Example 3.
Figure 13B:
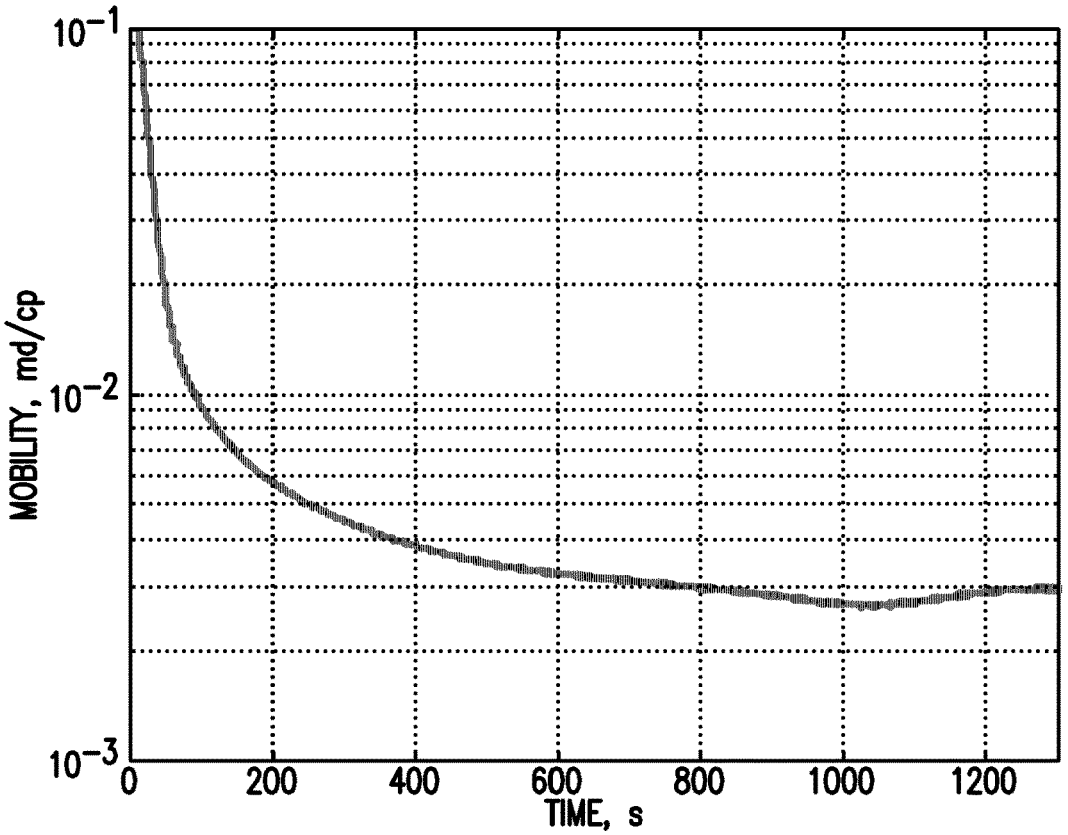
Figure 13C:
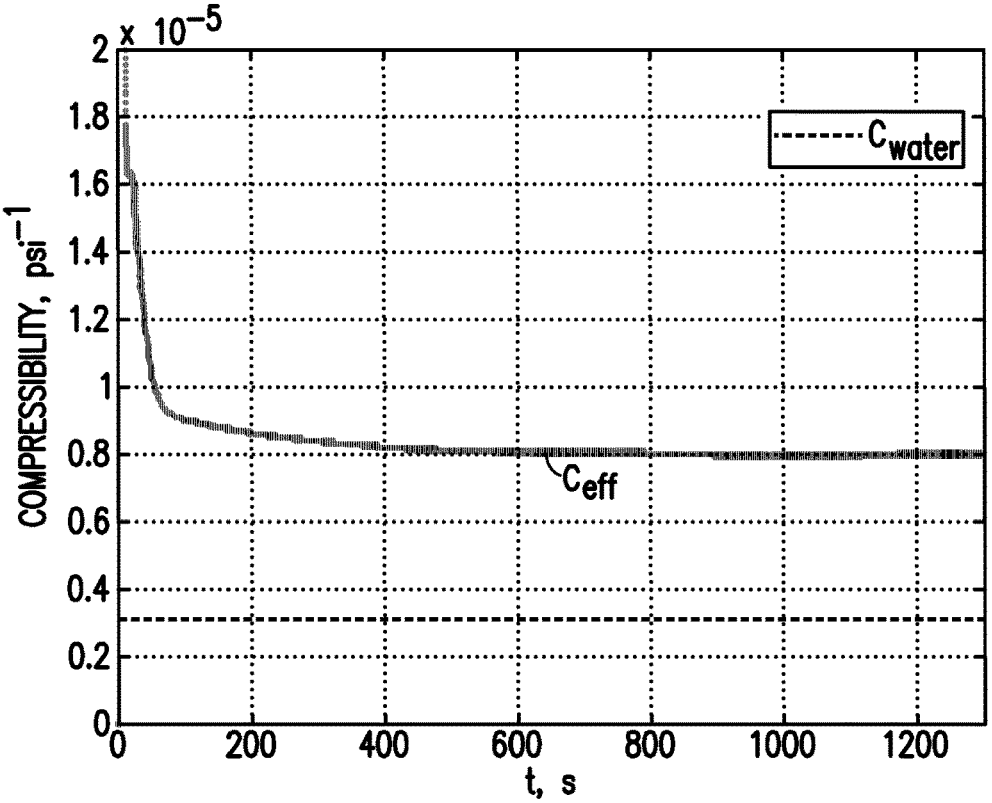

An analysis of the buildup is shown in FIG. 13*a*. Since the difference between the measured $P_{fl}$ and the calculated dry test is substantial, the possibility of a false buildup is eliminated. However, the predicted $P_{sand}$ is very close to (within 1% of) $P_{well}$ (6003.5 psi). It can be seen by around 400 seconds ($P_{sand}$=5953.5 psi) or even earlier that the pressure will equilibrate to $P_{well}$. The computed mobility shown in FIG. 13*b* is very low 0.003-0.004 mD $cp^{-1}$ and exhibits low variation after 400 seconds. However, there is no evidence that this mobility value corresponds to the formation. The conclusion that may be drawn from this test is that at 500 seconds the final equilibration pressure and the mobility are known, and therefore there is no value added in waiting an additional 13 minutes for $P_{fl}$ to equilibrate. Since a total of 50 stations were made in this well, many with a similar pressure behavior, this method has a potential to contribute significant time savings in field operations.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method for conducting a pretest with a formation tester tool located in a borehole traversing a formation, comprising:

a) obtaining a dry buildup pressure curve ($P_{bu,dry}(t)$) for the formation tester tool;

b) conducting a drawdown procedure followed by a buildup with said formation tester tool;

c) constantly measuring flowline pressure ($P_{fl}$) of the formation tester tool over time during the buildup to obtain flowline pressure values; and d) in a processor coupled to the formation tester tool, comparing said flowline pressure values over time with said dry buildup pressure curve, and if a difference in pressure values of said flowline pressure and said dry buildup pressure is below a first threshold value for a first defined period of time, discontinuing the pretest, and otherwise continuing the pretest.

2. A method for conducting a pretest according to claim 1, further comprising:

said first defined period of time is no greater than 120 seconds.

3. A method for conducting a pretest according to claim 1, further comprising:

for intervals of time ($\Delta t$) during said buildup, determining sandface pressure ($P_{sand}$) from said flowline pressure.

4. A method for conducting a pretest according to claim 3, wherein:

said sandface pressure is determined according to $$P_{sand} = P_{fl} - \frac{\frac{dP_{fl}}{dt}}{\frac{d}{dt}\left(\ln\frac{dP_{fl}}{dt}\right)}.$$

5. A method according to claim 3, further comprising:

comparing over time said sandface pressure with a pressure of the borehole, and if a difference in pressure values of said sandface pressure and said borehole pressure is below a second threshold value for a second defined period of time, discontinuing the pretest, and otherwise continuing the pretest.

6. A method according to claim 5, wherein:

said second threshold value is two percent of said borehole pressure.

7. A method according to claim 3, further comprising:

comparing over time said sandface pressure with a pressure of the borehole, and if said sandface pressure appears that it will converge to substantially said borehole pressure, discontinuing the pretest, and otherwise continuing the pretest.

8. A method according to claim 3, further comprising:

computing formation mobility from said sandface pressure, and discontinuing the pretest if said formation mobility does not stabilize to a constant value over time.

9. A method according to claim 8, further comprising:

computing effective flowline compressibility as a function of said sandface pressure, and comparing said computed effective flowline compressibility to a known effective flowline compressibility range for the tool.

10. A method according to claim 1, further comprising:

plotting said flowline pressure values over time and said dry buildup pressure curve on a graph.

11. A method according to claim 7, further comprising:

plotting said flowline pressure values over time, said dry buildup pressure curve, said sandface pressure, and said borehole pressure on a graph.

12. A method of conducting a pretest with a formation tester tool located in a borehole traversing a formation, comprising:

a) obtaining a dry buildup pressure curve ($P_{bu,dry}(t)$) for the formation tester tool;

b) conducting a drawdown procedure followed by a buildup with said formation tester tool;

c) constantly measuring flowline pressure ($P_{fl}$) of the formation tester tool over time during the buildup to obtain flowline pressure values;

d) in a processor coupled to the formation tester tool, comparing said flowline pressure values over time with said dry buildup pressure curve, and if a difference in pressure values of said flowline pressure and said dry buildup pressure is below a first threshold value for a first defined period of time, discontinuing the pretest, and otherwise continuing the pretest;

e) in the processor, for intervals of time ($\Delta t$) during said buildup, determining sandface pressure ($P_{sand}$) from said flowline pressure according to $$P_{sand} = P_{fl} - \frac{\frac{dP_{fl}}{dt}}{\frac{d}{dt}\left(\ln\frac{dP_{fl}}{dt}\right)};$$

and f) in the processor, comparing over time said sandface pressure with a pressure of the borehole, wherein if a difference in pressure values of said flowline pressure and said dry buildup pressure is below a first threshold value for a first defined period of time, or if a difference in pressure values of said sandface pressure and said borehole pressure is below a second threshold value for a second defined period of time, discontinuing the pretest, and otherwise continuing the pretest.

13. A method according to claim 12, wherein:

said first defined period of time is equal to said second defined period of time.

14. A method according to claim 12, further comprising:

computing formation mobility from said sandface pressure, and discontinuing the pretest if said formation mobility does not stabilize to a constant value over time.

15. A method according to claim 14, further comprising:

computing effective flowline compressibility as a function of said sandface pressure, and comparing said computed effective flowline compressibility to a known effective flowline compressibility range for the tool.

16. A method according to claim 12, further comprising:

plotting said flowline pressure values over time, said dry buildup pressure curve, said sandface pressure, and said borehole pressure on a graph.

17. A method of conducting a pretest with a formation tester tool located in a borehole traversing a formation, comprising:

a) conducting a drawdown procedure followed by a buildup with said formation tester tool;

b) constantly measuring flowline pressure ($P_{fl}$) of the formation tester tool over time during the buildup to obtain flowline pressure values;

c) in a processor coupled to the formation tester tool, for intervals of time ($\Delta t$) during said buildup, determining sandface pressure ($P_{sand}$) from said flowline pressure according to $$P_{sand} = P_{fl} - \frac{\frac{dP_{fl}}{dt}}{\frac{d}{dt}\left(\ln\frac{dP_{fl}}{dt}\right)};$$

and d) in the processor, comparing over time said sandface pressure with a pressure of the borehole, wherein if a difference in pressure values of said sandface pressure and said borehole pressure is below a threshold value for a defined period of time or said pressure values of said sandface pressure appear to converge substantially to said borehole pressure, discontinuing the pretest, and otherwise continuing the pretest.

18. A method according to claim 17, further comprising:

computing formation mobility from said sandface pressure, and discontinuing the pretest if said formation mobility does not stabilize to a constant value over time.

19. A method according to claim 18, further comprising:

computing effective flowline compressibility as a function of said sandface pressure, and comparing said computed effective flowline compressibility to a known effective flowline compressibility range for the tool.

20. A method according to claim 17, further comprising:

plotting said sandface pressure and said borehole pressure on a graph.

* * * * *